US009340910B2

(12) United States Patent
Shomura

(10) Patent No.: US 9,340,910 B2
(45) Date of Patent: May 17, 2016

(54) OVERLOCK SEWING MACHINE

(71) Applicant: Janome Sewing Machine Co., Ltd., Tokyo (JP)

(72) Inventor: Eiichi Shomura, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 57 days.

(21) Appl. No.: 14/523,830

(22) Filed: Oct. 24, 2014

(65) Prior Publication Data

US 2015/0267333 A1 Sep. 24, 2015

(30) Foreign Application Priority Data

Mar. 18, 2014 (JP) ..... 2014-055393

(51) Int. Cl.

*D05B 1/20* (2006.01)
*D05B 57/34* (2006.01)
*D05B 63/00* (2006.01)
*D05B 87/02* (2006.01)

(52) U.S. Cl.

CPC ..... *D05B 57/34* (2013.01); *D05B 63/00* (2013.01); *D05B 87/02* (2013.01); *D05D 2207/04* (2013.01)

(58) Field of Classification Search

CPC ..... D05B 87/00; D05B 87/02; D05B 63/00; D05B 57/00; D05B 57/02; D05B 57/30; D05B 57/34; D05B 1/12; D05B 1/20; B65H 57/12

See application file for complete search history.

(56) References Cited

U.S. PATENT DOCUMENTS 4,503,794 A * 3/1985 Ishihara ..... D05B 27/04 112/313
4,543,896 A * 10/1985 DeSantis ..... D05B 57/06 112/162
5,301,622 A * 4/1994 Sakuma ..... D05B 57/06 112/162
5,327,841 A 7/1994 Sakuma
5,513,588 A * 5/1996 Kojima ..... D05B 1/20 112/197
6,880,472 B2 * 4/2005 Horiuchi ..... D05B 87/02 112/199
8,857,354 B2 * 10/2014 Sakuma ..... D05B 87/00 112/199
8,939,097 B2 * 1/2015 Suzuki ..... D05B 63/00 112/199
9,194,069 B2 * 11/2015 Shomura ..... D05B 87/00
2008/0134950 A1 * 6/2008 Sadasue ..... D05B 1/10 112/201
2008/0236466 A1 * 10/2008 Sadasue ..... D05B 57/30 112/302
2008/0257241 A1 * 10/2008 Sadasue ..... D05B 81/00 112/225
2012/0210922 A1 * 8/2012 Sakuma ..... D05B 87/00 112/199
2014/0083344 A1 3/2014 Sakuma et al.

FOREIGN PATENT DOCUMENTS

JP H05-228285 A 9/1993
JP H06-277383 A 10/1994
JP 2013-00338 A 1/2013

* cited by examiner

*Primary Examiner* — Nathan Durham
(74) *Attorney, Agent, or Firm* — Nakanishi IP Associates, LLC

(57) ABSTRACT

An overlock sewing machine includes a main shaft fixing operating arm provided with a shaft pin engaging portion that engages with a fixing inner shaft pin and an arm provided to be operable by a user which are integrally rockable within a specified range, and further includes a main shaft fixing operating spring which urging direction is switched in both directions of an rocking direction by exceeding a neutral point by the rocking movements of the main shaft operating arm and the arm. Further, a switching cam ring is fixed to the main shaft fixing operating shaft that obtains driving force upon abutment of a slide plate pin of the slide plate to rotate the main shaft fixing operating shaft.

3 Claims, 41 Drawing Sheets

OVERLOCK SEWING MACHINE

CROSS REFERENCE TO RELATED APPLICATIONS

This application is based on and claims the benefit of priority to Japanese Patent Application No. 2014-055393 filed on Mar. 18, 2014, the contents of which are hereby incorporated by reference in their entirety.

TECHNICAL FIELD

The present invention relates to an overlock sewing machine in which looper threads can be threaded to loopers utilizing power of air.

BACKGROUND ART

An overlock sewing machine is provided with a plurality of loopers, and since it is necessary to thread each of the loopers with respectively different looper threads, threading operations were troublesome.

Patent Document 1 discloses a device for threading a thread to a hollow looper point using compressed air.

Patent Document 2 discloses a compressed air path switching device corresponding to a plurality of loopers.

These techniques have enabled easy threading operations of looper threads to loopers.

On the one hand, the devices disclosed in Patent Document 1 and Patent Document 2 mainly included the following two issues.

The first issue is that when a threading enabled phase is detected and the phase is to be maintained, operations of pressing a fixing button and operations of rotating a thread take-up lever need to be performed simultaneously so that operations need to be made using both hands.

The second issue is that it can be hardly determined at a glance whether the overlock sewing machine is in a "sewing enabled state" or in a "threading state (or threading preparing state)".

In the device disclosed in Patent Document 3, there are provided a push button including a control pin and a control groove cam portion receiving the control pin, wherein the push button, the control groove cam portion and a main shaft are separately operable with one hand.

PRIOR ART LITERATURE

Patent Literature

[Patent Literature 1] Japanese Patent Laid-Open Publication No. 5-228285

[Patent Literature 2] Japanese Patent Laid-Open Publication No. 6-277383

[Patent Literature 3] Japanese Patent Laid-Open Publication No. 2013-338

SUMMARY OF THE INVENTION

However, in the device of Patent Document 3, a user needs to operate a member including the groove cam in a sliding manner, which lead to negative impression of operability. More particularly, in the device of Patent Document 3, large load changes are caused when the control pin runs onto a plurality of cam positions, and these load changes are directly caught by the user. Particularly for users who operate this device for the first time, there were cases in which they felt uneasy whether they should proceed with further operations since sliding of the operating member felt suddenly heavier.

Further, the device of Patent Document 3 can be hardly determined at a glance whether the overlock sewing machine is in a "sewing enabled state" or in a "threading state (or threading preparing state)".

One or more embodiments of the present invention provides an overlock sewing machine in which looper threading operations to loopers can be performed with one hand with favorable operation feelings as well as through a small amount of operating steps and in which it is easy to determine whether it is in a sewing enabled state or not.

Embodiment (1)

One or more embodiments of the present invention relate to an overlock sewing machine comprising at least one looper including an receiving opening for receiving a looper thread and having a hollow structure through which the looper thread passes; a thread inserting opening into which the looper thread is inserted that is to be inserted to the looper; a looper conduction pipe that guides the looper thread inserted into the thread inserting opening towards the receiving opening; a slide pipe provided between the looper conduction pipe and the receiving opening and which one end is fitted to the looper conduction pipe in a freely slidable manner while its other end is provided to be movable between a threading position at which it is connected to the receiving opening and a sewing executing position at which the other end is separated from the receiving opening; a slide member which is a member that holds the slide pipe and that moves between the threading position and the sewing executing position together with the slide pipe, having a long hole portion that extends along the moving direction and a wide hole portion that is formed in connection with the long hole portion and which width is formed to be larger than the width of the long hole portion; a slide member spring for urging the slide member and the slide pipe towards the receiving opening side; a main shaft that is rotationally driven; a main shaft fixing plate that is fixed to the main shaft and that includes a notch at an outer peripheral position corresponding to a threading phase at which the receiving opening is at a position at which it is connectable to the other end of the slide pipe; a first shaft which is an axial member which one end is provided to be movable between an engaging position at which it engages with the notch for fixing the main shaft at the threading phase and a retracted position at which it is completely separated from the main shaft fixing plate, comprising a small diameter portion and a large diameter portion at the other end thereof that respectively engage with the long hole portion and the wide hole portion of the slide member, wherein the position of the sliding member is maintained at each of the threading position and the sewing executing position through the engagement of the small diameter portion and the large diameter portion with the long hole portion and the wide hole portion; a second shaft that is provided to be relatively movable along an axial direction of the first shaft; a shaft spring for urging the first shaft and the second shaft in mutually separating directions; a shaft pin that is provided at the second shaft to project from the second shaft or that engages with the second shaft to be integrally movable in an axial direction of the second shaft; an engaging portion that is provided at the first shaft to engage with the shaft pin and/or the second shaft to receive force to move the first shaft towards the main shaft fixing plate side; a rocking lever portion including a main shaft fixing operating arm portion provided with a shaft pin engaging portion that engages with the shaft pin or with the shaft pin and a main shaft fixing lever portion provided to be operable by a user and being rockable within a specified range; and a main shaft fixing operating spring which urging direction is switched to both rocking directions of the rocking lever portion by exceeding a neutral point through rocking operations of the rocking lever portion.

Embodiment (2)

One or more embodiments of the present invention relate to an overlock sewing machine in which the overlock sewing machine of the above embodiment 1 comprises a casing member formed with an opening portion that is visible to at least the user at the time of operation, wherein a part of the first shaft and/or a part of an identifying member that moves integrally with the first shaft comes to a position at which it is exposed from the opening portion when the first shaft has moved to the retracted position to indicate that the sewing machine is in a sewing executable state in which the slide pipe and the slide member have moved to the sewing executing position so as to enable sewing.

Embodiment (3)

One or more embodiments of the present invention relate to an overlock sewing machine in which the overlock sewing machine of the above embodiment 1 comprises a switch that allows driving of a motor for driving the main shaft only when the first shaft has moved to the retracted position so that the sewing machine is in a sewing executable state so as to enable sewing.

According to one or more embodiments of the present invention, it is possible to perform looper threading operations to the loopers by one hand with favorable operating feelings as well as through a small amount of operating steps and it is also possible to easily determine whether it is in a sewing executable state or not.

DETAILED DESCRIPTION OF THE PREFERRED EMBODIMENTS

Figure 1:
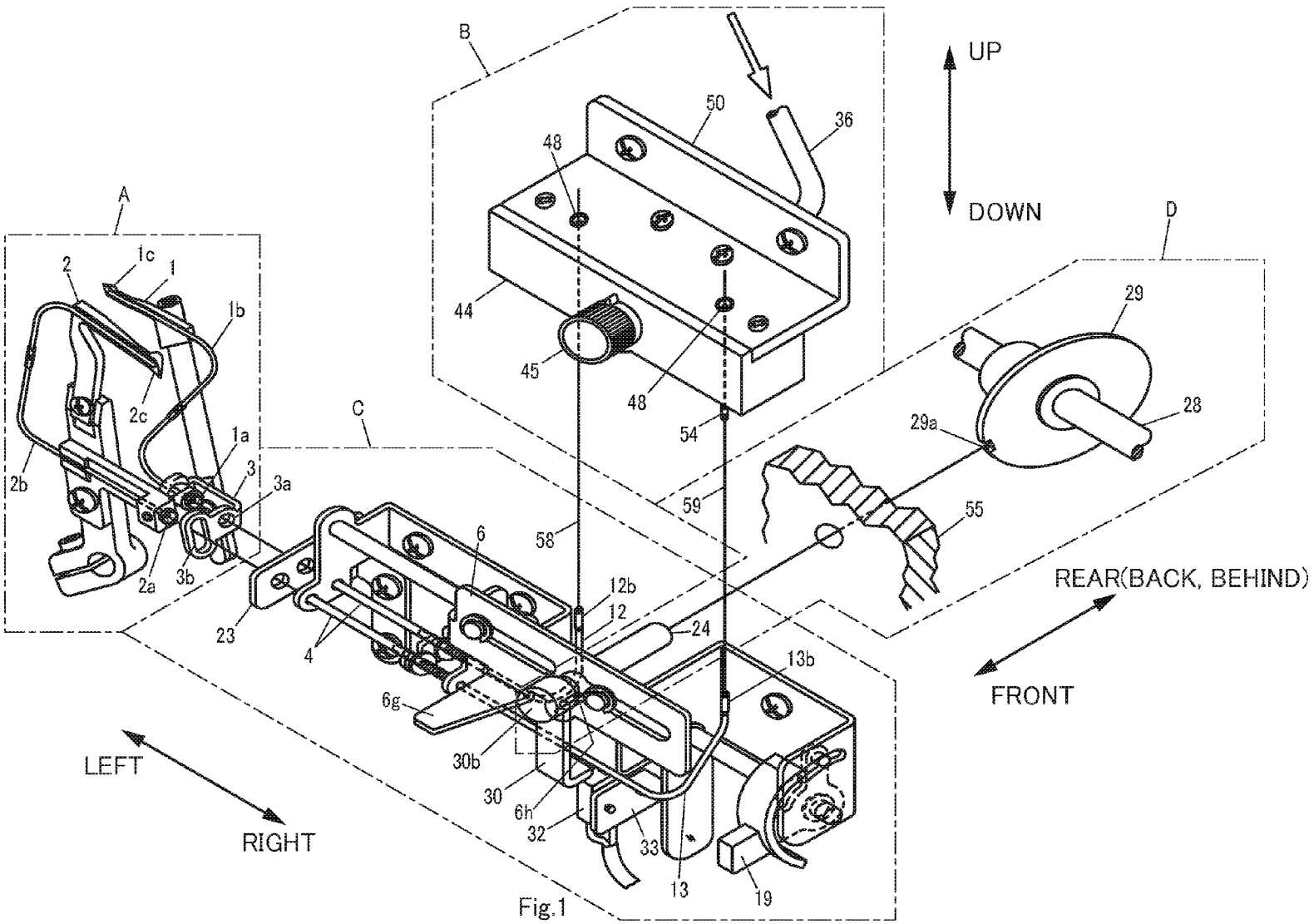
FIG. 1 A perspective view of main portions for showing one embodiment of an overlock sewing machine according to the present invention.

Best modes for embodying the present invention will now be explained while referring to the drawings and others.

First Embodiment

FIG. 1 is a perspective view of main portions for showing an embodiment of an overlock sewing machine according to the present invention.

In this respect, each of the drawings including FIG. 1 indicated hereinafter are schematically illustrated drawings and sizes and shapes of respective portions are shown in suitably exaggerated form for ease of understanding.

Further, while explanations are made upon indicating specific numerical values, shapes and materials in the following explanations, they may be suitably changed.

Moreover, for ease of understanding and for convenience sake, explanations will be made by suitably using the six directions of front (or near), rear (or back, behind), left, right, up and down as indicated by arrows in FIG. 1. However, these directions are not to limit the arrangement of the invention.

In the present embodiment, explanations will be made by giving a case of an overlock sewing machine comprising two loopers (upper looper 1, lower looper 2). However, the present invention is also applicable to sewing machines in which threading to one or more than three loopers is performed.

The overlock sewing machine according to the present embodiment includes a looper portion A, an air flow path switching mechanism B, a looper thread path C and a main shaft fixing mechanism D as main arrangements as indicated by one dot chain lines in FIG. 1. In this respect, while the overlock sewing machine further comprises needles, a motor and various driving mechanisms, details thereof will be omitted here.

The looper portion A comprises an upper looper 1 and a lower looper 2 of hollow structure for receiving an upper looper thread 58 and a lower looper thread 59 that are sent by means of the air flow path switching mechanism B and the looper thread path C. The upper looper 1 and the lower looper 2 respectively include an upper looper receiving opening 1*a* and a lower looper receiving opening 2*a* for receiving the respective looper threads.

The upper looper receiving opening 1*a* communicates up to an upper looper point 1*c* via a pipe-like member 1*b*. The lower looper receiving opening 2*a* communicates up to a lower looper point 2*c* via a pipe-like member 2*b*. A looper thread take-up 3 includes an upper looper thread hole 3*a* and a lower looper thread hole 3*b*. The upper looper 1 and the lower looper 2 perform reciprocating movements while keeping intersection timings with a needle (not shown) that is vertically moved through rotation of a main shaft 28 that is driven by a motor (not shown).

Figure 2:
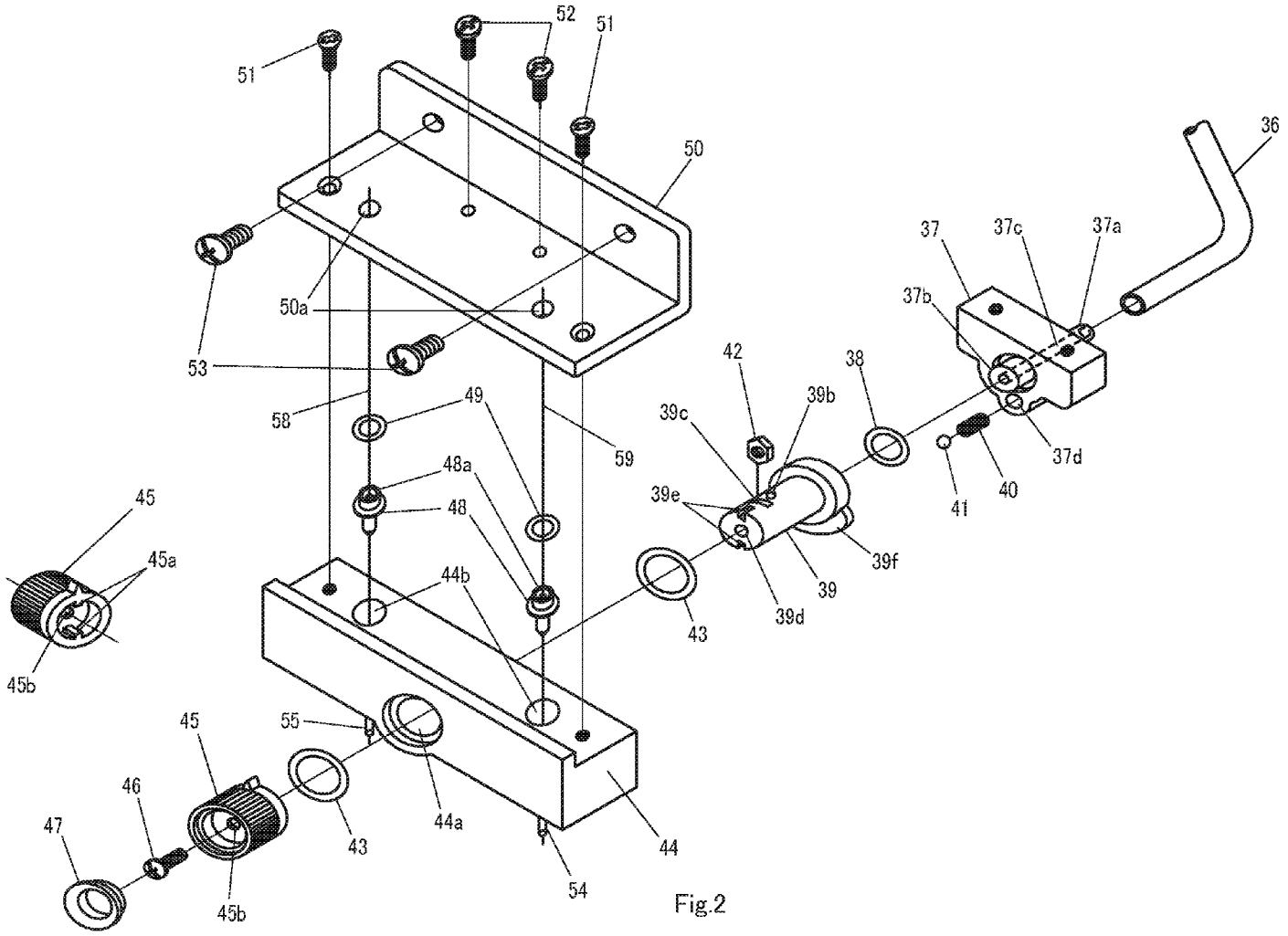
FIG. 2 An exploded perspective view of an air flow path switching mechanism B.

FIG. 2 is an exploded perspective view of the air flow path switching mechanism B.

The air flow path switching mechanism B is a mechanism for switching a flow path of compressed air that is supplied to a tube 36 so as to switch between threading of the upper looper thread 58 and threading of the lower looper thread 59.

Compressed air that is generated by a compressed air generator (not shown) is supplied to the tube 36. One end of the tube 36 is connected to a hollow boss 37*a* of a coupling body 37. A hollow boss 37*b* provided on the other end side of the hollow boss 37*a* is attached with an O ring 38 and is fit to a back portion of a switching shaft 39.

A hollow hole 37*c* piercing through the hollow bosses 37*a*, 37*b* lets the compressed air from the tube 36 flow through.

A concave portion 37*d* is formed on a side of the coupling body 37 opposing the switching shaft 39 (front side), wherein a click spring 40 is fitted in the back thereof while a click steel ball 41 is fitted in front thereof. A part of the click steel ball 41 protrudes from a surface of the coupling body 37. The switching shaft 39 includes a hollow hole 39*a* (see FIG. 8 and FIG. 9) corresponding to the hollow hole 37*c* of the coupling body 37 and is in succession with a hole 39*b* on an outer peripheral surface of an axial portion of the switching shaft 39. An angular hole 39*c* for accommodating a hexagonal nut 42 is disposed at an axial portion of the switching shaft 39, and a central hole 39*d* formed on an end surface on the near side of the switching shaft 39 extends up to the angular hole 39*c*. Two angular grooves 39*e* are formed at suitable length from the end surface on the near side of the switching shaft 39 along an axial direction.

A flange 39*f* is formed at a rear end of the switching shaft 39 in a fan-like manner. A rear surface of the flange 39*f* includes two hemispherical concave portions 39*g* (see FIG. 7 and FIG. 9) at a specified interval at positions corresponding to the concave portions 37*d* of the coupling body 37.

The switching shaft 39 is arranged in that an O ring 43 is attached to its axial portion and in that it pierces through a central hole 44*a* of a branching body 44. The switching shaft 39 piercing through the branching body 44 is attached with the 0 ring 43 from the near side, and two angular protrusions 45*a* of a looper selecting knob 45 and the two angular grooves 39*e* of the switching shaft 39 are in mesh and fit together. In this respect, the looper selecting knob 45 disposed such that its back surface side is visible is added in FIG. 2. The switching shaft 39 and the looper selecting knob 45 are coupled and fixed by means of a screw 46 passing through a central through hole 45*b* of the looper selecting knob 45 and the hexagonal nut 42 inserted into the switching shaft 39. A cap 47 serves as a lid from in front of the looper selecting knob 45, and the screw 46 is hidden from the surface.

Figure 8:
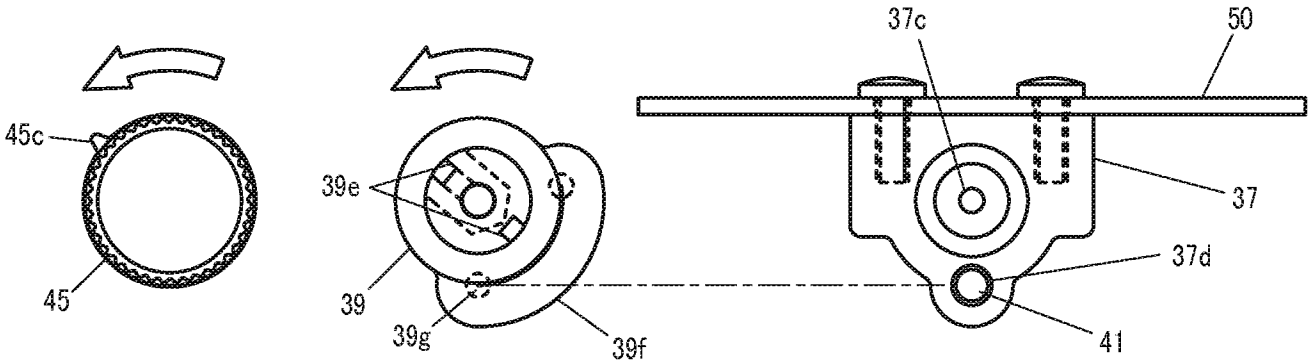
FIG. 8 A view showing a relationship of a coupling body 37, a switching shaft 39 and a looper selecting knob 45 in a state in which the looper selecting knob 45 is operated to a side of performing threading of an upper looper thread 58 (left side) (hereinafter referred to as "upper looper threading state").
Figure 9:
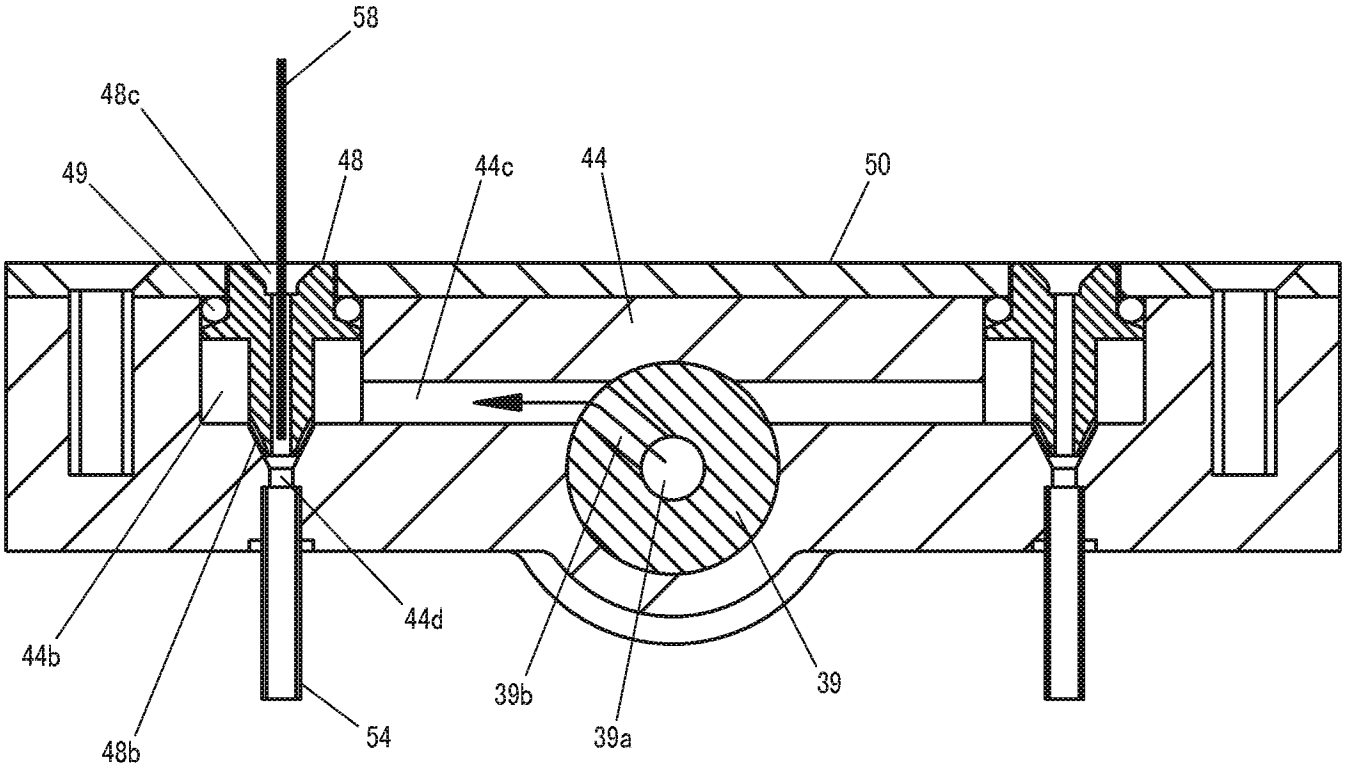
FIG. 9 A sectional view of the air path switching mechanism B cut at a position indicated by arrow E-E in FIG. 7 in the upper looper threading state.

Two concave portions 44*b* are disposed on an upper surface of the branching body 44, and two thread inserting openings 48 are accommodated in these concave portions 44*b*. The branching body 44 is fixed to a branching base plate 50 by means of screws 51 in a condition in which 0 rings 49 are attached to upper portion bosses 48*a* of the thread inserting openings 48. The upper portion bosses 48*a* of the thread inserting openings 48 are exposed from round holes 50*a* of the branching base plate 50 so as to enable insertion of the upper and lower looper threads. In this respect, the inner structure of the branching body 44 is shown in FIG. 8, FIG. 9 and others.

The coupling body 37 is fixed to the branching base plate 50 by means of screws 52. With this arrangement, compressed air generated by the compressed air generator (not shown) reaches the branching body 44 upon passing the tube 36, the coupling body 37 and the switching shaft 39.

The branching base plate 50 is fixed to a main body of the sewing machine (not shown) or a unit base 55 by means of screws 53.

Figure 3:
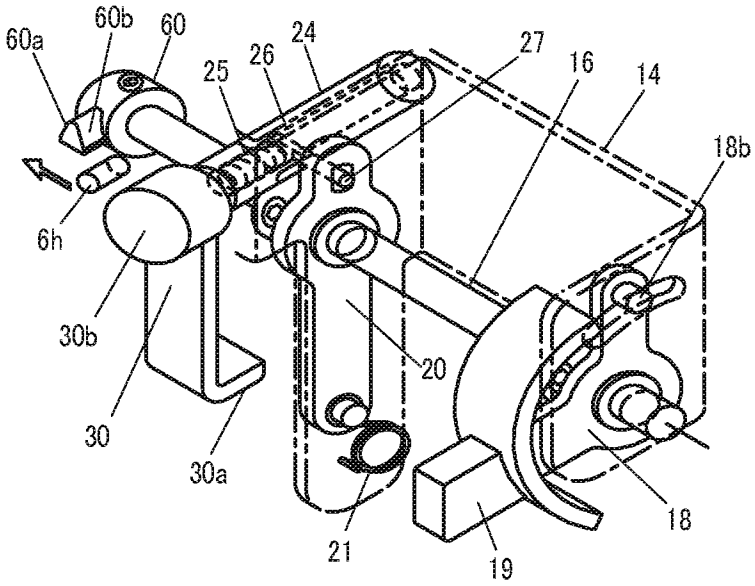
FIG. 3 A perspective view showing an arrangement of a looper thread path C proximate of its right end portion by means of a state of seeing through a slide plate support 14.

FIG. 3 is a perspective view showing an arrangement of the looper thread path C proximate of its right end portion by means of a state of seeing through a slide plate support 14.

Figure 4:
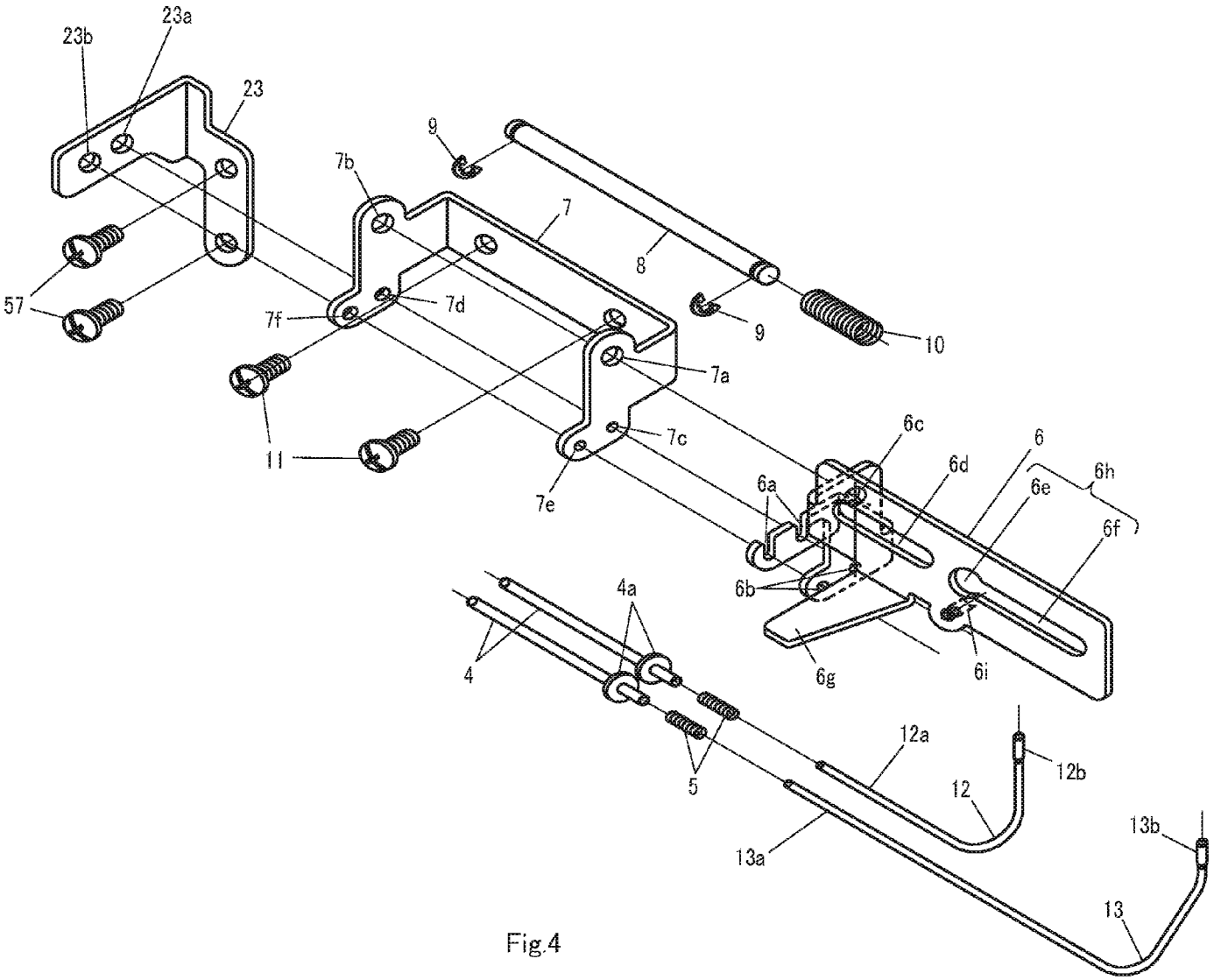
FIG. 4 An exploded perspective view proximate of a slide plate 6 of the looper thread path C.

FIG. 4 is an exploded perspective view proximate of a slide plate 6 of the looper thread path C.

Figure 5:
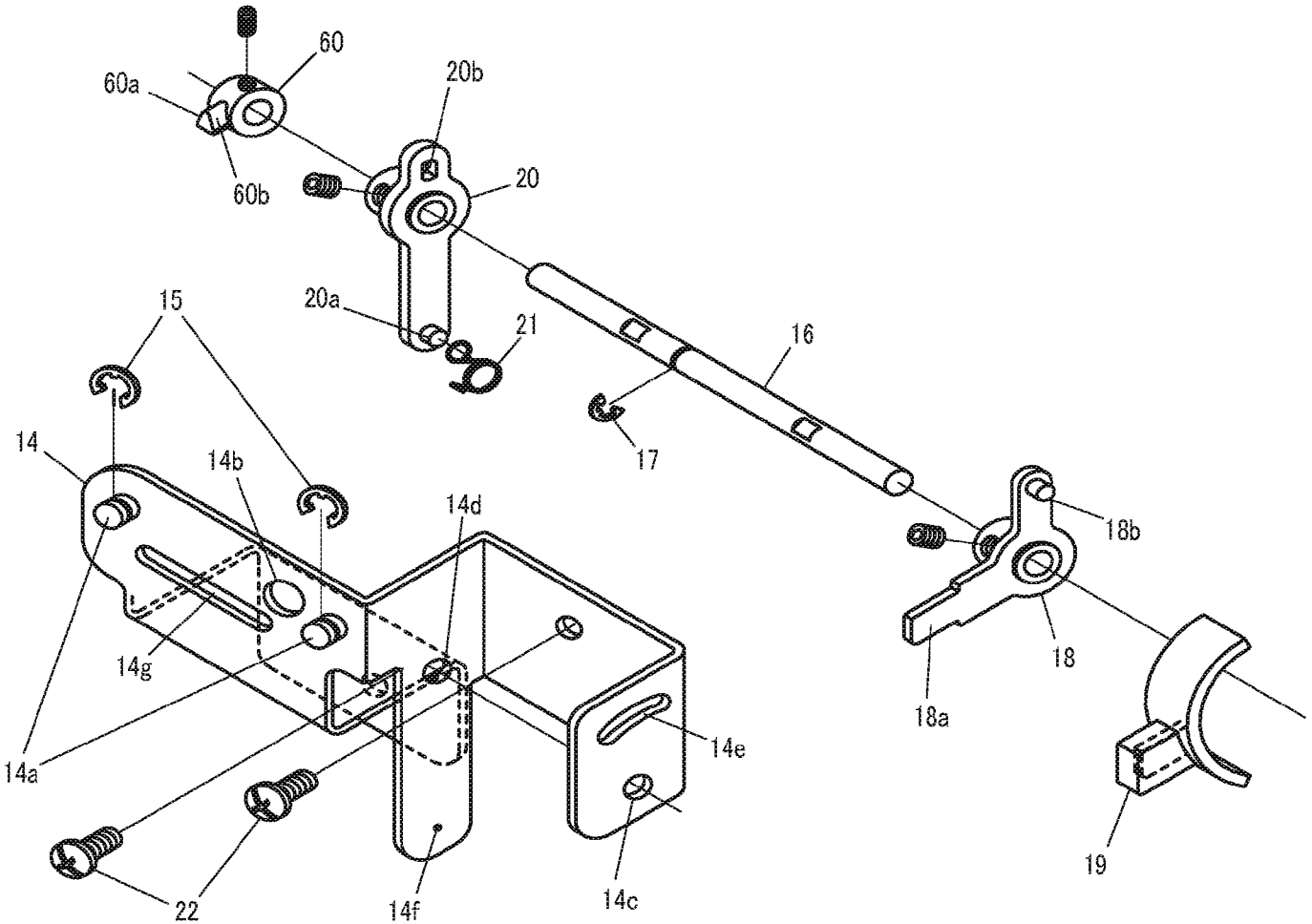
FIG. 5 An exploded perspective view proximate of the slide plate support 14 of the looper thread path C.

FIG. 5 is an exploded perspective view proximate of the slide plate support 14 of the looper thread path C.

The slide pipe 4 receives the slide pipe spring 5 at its flange portion 4*a* and is inserted into a U groove 6*a* of the slide plate 6 using the flange portion 4*a* as a strike plate. The slide pipe 4 is fitted to an upper looper conduction pipe 12 and a lower looper conduction pipe 13, respectively, in a freely sliding manner. The slide pipe 4 moves between a threading position and a sewing executing position following movements of the slide plate 6.

The slide pipe spring 5 fits to the slide pipe 4 and press-contacts the slide pipe 4 against the upper looper receiving opening 1*a* and the lower looper receiving opening 2*a* when moving the slide pipe 4 to the threading position.

The slide plate (slide member) 6 includes 2 round holes 6*b* on an opposite side corresponding to the two U grooves 6*a*. The portion of the slide plate 6 including the U grooves 6*a* and the round holes 6*b* is disposed on an inner region (region pinched by opposing portions to be described later) of a looper pipe supporting plate 7. The slide plate 6 holds the slide pipe 4 and moves between the threading position and the sewing executing position together with the slide pipe 4.

The looper pipe supporting plate 7 is formed to have a shape in which its opposing portions, which are provided on both sides of portions extending in lateral directions to oppose each other, are respectively bent frontward to stand up (so-called U-shaped form). The looper pipe supporting plate 7 includes through holes 7*a*, 7*b* at the opposing portions. The slide plate 6 is formed with a round hole 6*c* corresponding to the through holes 7*a*, 7*b* on the same surface as the above-mentioned two round holes 6*b*.

A supporting plate shaft 8 pierces through the through holes 7*a*, 7*b* of the looper pipe supporting plate 7 and the round hole 6*c* of the slide plate 6, and is fixed to the looper pipe supporting plate 7 by fastening E-shaped snap rings 9 to both ends thereof. The supporting plate shaft 8 maintains a supporting plate shaft spring 10 between the round hole 6*c* of the slide plate 6 and the through hole 7*a* of the looper pipe supporting plate 7. Since the looper pipe supporting plate 7 is fixed to the main body of the sewing machine (not shown) or the unit base 55 by means of screws 11, the slide plate 6 is continuously urged in the a left direction by means of the supporting plate shaft spring 10.

The supporting plate shaft spring 10 constantly urges the slide plate 6 and the slide pipe 4 in the left direction and serves as a driving source for moving the slide plate 6 and the slide pipe 4 in the left direction at the time of switching threading.

A linear portion 12*a* of the upper looper conduction pipe 12 pierces through a right-side surface hole 7*c* of the looper pipe supporting plate 7 and the round hole 6*b* of the slide plate 6, pierces further through the slide pipe spring 5 and the slide pipe 4 and pierces up to a left-side surface hole 7*d* of the looper pipe supporting plate 7 together with the slide pipe 4.

A linear portion 13*a* of the lower looper conduction pipe 13 pierces through a right-side surface hole 7*e* of the looper pipe supporting plate 7 and the round hole 6*b* of the slide plate 6, pierces further through the slide pipe spring 5 and the slide pipe 4 and pierces up to a left-side surface hole 7*f* of the looper pipe supporting plate 7 together with the slide pipe 4.

The slide plate 6 includes a long hole 6*d* and a heteromorphic long hole 6*h*.

The heteromorphic long hole 6*h* includes a long hole portion 6*f* extending along a moving direction of the slide plate 6 (lateral direction) and a wide hole portion 6*e* that is formed in connection with the long hole portion 6*f* and to have a width that is formed to be larger than the width of the long hole portion 6*f*.

A slide plate support 14 is fixed to the main body of the sewing machine (not shown) or the unit base 55 by means of screws 22. The slide plate support 14 holds the slide plate 6 and the main shaft fixing outer shaft 24, and it further holds a main shaft fixing operating shaft 16, the main shaft fixing operating arm 20 and a main shaft fixing lever 18.

The slide plate support 14 is provided with a pin with E grooves 14*a* on one end thereof, and a pin with E grooves 14*a* is similarly disposed also on the other end thereof. The slide plate support 14 holds the slide plate 6 in a freely sliding manner by being fixed by the E-shaped snap ring 15 in a condition in which the long hole 6*d* and the long hole portion 6*f* of the slide plate 6 are fitted with the respective pins with E grooves 14*a*. A projecting knob portion 6*g* is formed in substantially the center of the slide plate 6. When the projecting knob portion 6*g* is pinched and operated by the user, the slide plate 6 can be moved to the right against the supporting plate shaft spring 10.

Further, a slide plate pin (abutting portion) 6*i* is fixed to the slide plate 6 proximate of the projecting knob portion 6*g* and in a direction opposite to the projecting knob portion 6*g* (back surface side). The slide plate pin 6*i* is comprised of a round pin integrally fixed to the slide plate 6. In accordance with the movement of the slide plate 6, the slide plate pin 6*i* abuts a switching cam ring 60 to rotate and move the main shaft fixing operating shaft 16 to thereby rotate and move the main shaft fixing operating arm 20.

The slide plate support 14 includes the round hole 14*b* at substantially the center thereof and the main shaft fixing outer shaft 24 pierces through the round hole 14*b*. The slide plate support 14 includes the through holes 14*c*, 14*d* on a right half portion thereof. The main shaft fixing operating shaft 16 pierces through the through holes 14*c*, 14*d* and the main shaft fixing operating shaft 16 is provided at the slide plate support 14 to be freely rotating by means of the E-shaped snap ring 17.

The main shaft fixing lever 18 is fixed at the main shaft fixing operating shaft 16 inside of the right-side surface of the slide plate support 14 and is held to be freely rotating integrally with the main shaft fixing operating arm 20 upon eliminating backlash in a thrust direction in coaction with the E-shaped snap ring 17.

A fixing lever knob 19 is fixed at an arm 18*a* extending to the near side of the main shaft fixing lever 18 (main shaft fixing lever portion) to enable operation of the fixing lever knob 19 by the user at the time of switching between the threading state and the sewing executing state. A pin 18*b* is disposed on another arm extending upward of the main shaft fixing lever 18. The pin 18*b* fits into an arc-shaped long hole 14*e* located on a right end of the slide plate support 14 in a freely rocking manner. Through this fitting of the arc-shaped long hole 14*e* and the pin 18*b*, a rocking range of the main shaft fixing lever 18 is restricted.

The main shaft fixing operating arm (main shaft fixing operating arm portion) 20 is fixed to a left end of the main shaft fixing operating shaft 16. The main shaft fixing operating arm 20 performs rocking movements integrally with the main shaft fixing lever 18 through the main shaft fixing operating shaft 16. A pin 20*a* is disposed at one end of the main shaft fixing operating arm 20, and a main shaft fixing operating spring 21 is suspended between the pin and a small hole 14*f* of the slide plate support 14. The main shaft fixing operating spring 21 alternately performs urging movements in bipolar directions exceeding the neutral point through the rocking movements of the main shaft fixing operating arm 20. There is further provided a shaft pin engaging portion 20*b* formed to have a long hole shape at one end of the main shaft fixing operating arm 20. A fixing inner shaft pin 27 to be described later is engaged with the shaft pin engaging portion 20*b*. The main shaft fixing operating arm 20 moves a main shaft fixing inner shaft 26 and the main shaft fixing outer shaft 24 forward and backward with the shaft pin engaging portion 20*b* pressing the fixing inner shaft pin 27.

The main shaft fixing operating arm 20 is arranged in that it is alternately urged to the near side and the back side exceeding the neutral point through the action of the main shaft fixing operating spring 21. The main shaft fixing operating arm 20 is restricted in its rocking range through the fitting of the arc-shaped long hole 14*e* of the slide plate support 14 and the pin 18*b* of the main shaft fixing lever 18.

The switching cam ring 60 is fixed at a left end of the main shaft fixing operating shaft 16. The switching cam ring 60 is comprised of a substantially chevron cam having a left slope 60*a* and a right slope 60*b*. The switching cam ring 60 obtains driving force upon abutment of the slide plate pin 6*i* of the slide plate 6 and functions as a follower for rotating the main shaft fixing operating shaft 16, the main shaft fixing lever 18, the fixing lever knob 19 and the main shaft fixing operating arm 20 as the rocking lever portion. As described above, the slide plate pin 6*i* faces both sloped portions of the switching cam ring 60. In accordance with the movement of the slide plate 6, the slide plate pin 6*i* abuts the switching cam ring 60 either at the right slope 60*b* or the left slope 60*a* thereof to push the same whereby it is possible to rotate and move the switching cam ring 60 around the main shaft fixing operating shaft 16. With this arrangement, the main shaft fixing operating arm 20 and the main shaft fixing lever 18 rotate as well.

In this respect, a long hole 14*g* is formed proximate of the pin with E grooves 14*a* of the slide plate support 14. The slide plate pin 6*i* pierces through this long hole 14*g* to be moveable in lateral directions together with the slide plate 6.

In this respect, in the present embodiment, the rocking lever portion provided to be rocking within a specified range is comprised of the main shaft fixing operating shaft 16, the main shaft fixing lever 18, the fixing lever knob 19 and the main shaft fixing operating arm 20 as described above. However, the rocking lever portion could also be arranged by integrating a part or all of these parts.

A looper thread take-up guide 23 is disposed on a left end of the looper thread path C. The looper thread take-up guide 23 is formed with two round holes 23*a*, 23*b* at positions corresponding to the left-side surface holes 7*d*, 7*f* of the looper pipe supporting plate 7.

The looper thread take-up guide 23 is fixed to the main body of the sewing machine (not shown) or the unit base 55 by means of screws 57.

Figure 6:
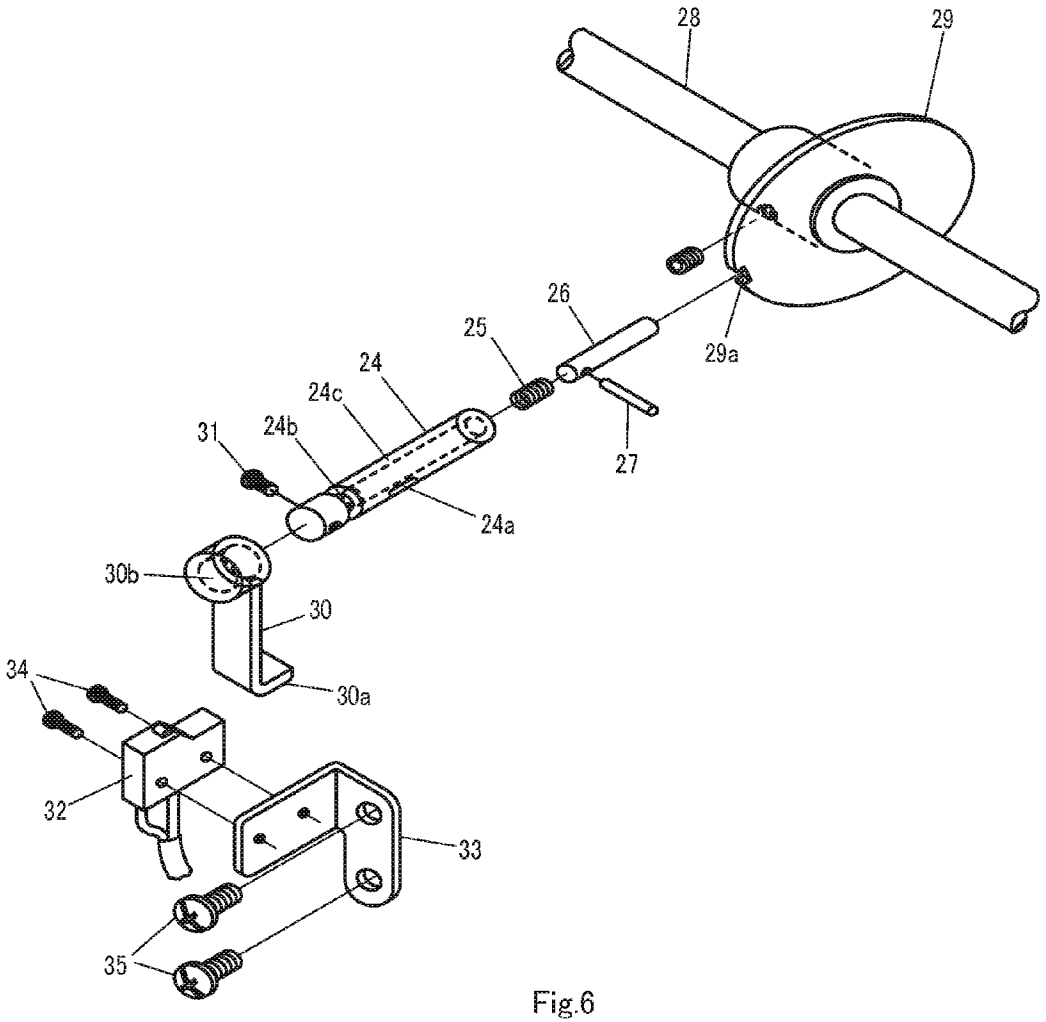
FIG. 6 An exploded perspective view of a main shaft fixing mechanism D.

FIG. 6 is an exploded perspective view of the main shaft fixing mechanism D.

The main shaft fixing outer shaft (first shaft) 24 fit to the round hole 14*b* of the slide plate support 14 has a hollow inner diameter portion, wherein a fixing inner shaft spring (shaft spring) 25 and the main shaft fixing inner shaft (second shaft) 26 are inserted into the hollow portion. Accordingly, the main shaft fixing inner shaft 26 is relatively movable along an axial direction of the main shaft fixing outer shaft 24. The main shaft fixing inner shaft 26 moves forward and backward through rocking movements of the main shaft fixing operating arm 20 through the fixing inner shaft pin 27 to be described later. The fixing inner shaft spring 25 urges the main shaft fixing outer shaft 24 and the main shaft fixing inner shaft 26 in mutually separating directions. With this arrangement, the fixing inner shaft spring 25 functions as an urging member for maintaining an intermediate position of the main shaft fixing outer shaft 24.

The fixing inner shaft pin (shaft pin) 27 is fixed such that it projects sideward to a tip end on the near side of the main shaft fixing inner shaft 26 through a side surface long hole (engaging portion) 24*a* of the main shaft fixing outer shaft 24. The fixing inner shaft pin 27 has a function of transmitting rocking movements of the main shaft fixing operating arm 20 to the main shaft fixing inner shaft 26. The fixing inner shaft pin 27 is movable in front and rear directions within a range in which the side surface long hole 24*a* of the main shaft fixing outer shaft 24 is formed, and the main shaft fixing inner shaft 26 moves within the main shaft fixing outer shaft 24 in accordance therewith. The side surface long hole 24*a* also has a function as an engaging portion that engages with the fixing inner shaft pin 27 to receive force of moving the main shaft fixing outer shaft 24 to a main shaft fixing plate 29 side.

The main shaft fixing plate 29 fixed to the main shaft 28 is disposed on an axial central line of the main shaft fixing outer shaft 24. A notch 29*a* that can fit with the main shaft fixing outer shaft 24 is disposed at a specified phase (corresponding to the threading phase) on an outer periphery of the main shaft fixing plate 29. When the main shaft fixing outer shaft 24 reaches a final position (engaging position), the main shaft fixing outer shaft 24 engages with the notch 29*a* to fix the main shaft 28 at the threading phase.

A motor switch cap (identification member) 30 is fastened at a tip end on the near side of the main shaft fixing outer shaft 24 by means of a screw 31. The motor switch cap 30 moves back and forth integrally with the main shaft fixing outer shaft 24.

The motor switch cap 30 includes a switch contacting surface 30*a* at a tip end of a downwardly extended arm thereof.

A micro switch (switch) 32 is disposed at a lower portion of the motor switch cap 30. The micro switch 32 is fixed at a switch mounting plate 33 by means of screws 34. The switch mounting plate 33 is fixed to the main body of the sewing machine or the unit base 55 by means of screws 35.

A circuit of the present embodiment (not shown) is arranged in that a motor driving circuit is switched ON only when the main shaft fixing outer shaft 24 is at a foremost position which is a retracted position in which it is completely separated from the main shaft fixing plate 29, that is, when the motor switch cap 30 is at a foremost position. This state is a state in which the slide plate 6 and the slide pipe 4 have moved to the right and corresponds to the sewing executable state.

The main shaft fixing outer shaft 24 comprises a small diameter portion 24*b* and a large diameter portion 24*c* that respective engage with the long hole portion 6*f* and the wide hole portion 6*e* of the slide plate 6. The main shaft fixing outer shaft 24 maintains the position of the slide plate 6 at either the threading position or the sewing executing position through the engagement of the small diameter portion 24*b* and the large diameter portion 24*c* with the long hole portion 6*f* and the wide hole portion 6*e*.

With the above-described arrangement, one end of the main shaft fixing outer shaft 24 fits the notch 29*a* of the main shaft fixing plate 29 to fix the main shaft 28 at the specified phase. Further, the other end of the main shaft fixing outer shaft 24 fits the heteromorphic long hole 6*h* of the slide plate 6 to maintain the slide plate 6 at the threading position and the sewing executing position, respectively. Moreover, the main shaft fixing outer shaft 24 constitutes a unit of the main shaft fixing outer shaft 24 by accommodating the fixing inner shaft spring 25, the main shaft fixing inner shaft 26 and the fixing inner shaft pin 27 in an inner diameter hole portion thereof.

Figure 7:
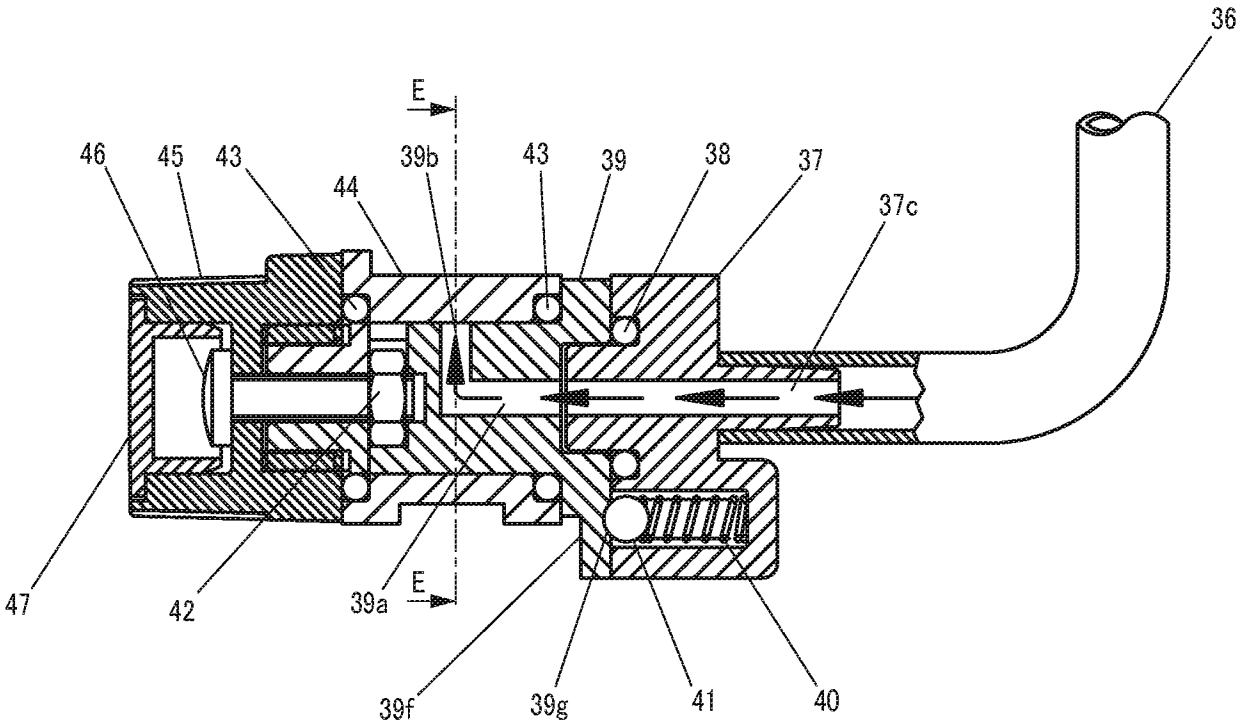
FIG. 7 A sectional view showing an inner structure of the air flow path switching mechanism B.

FIG. 7 is a sectional view showing an inner structure of the air flow path switching mechanism B.

FIG. 8 is a view showing a relationship of a coupling body 37, a switching shaft 39 and a looper selecting knob 45 in a state in which the looper selecting knob 45 is operated to a side of performing threading of an upper looper thread 58 (left side) (hereinafter referred to as "upper looper threading state").

FIG. 9 is a sectional view of the air path switching mechanism B cut at a position indicated by arrow E-E in FIG. 7 in the upper looper threading state.

For obtaining the upper looper threading state, the looper selecting knob 45 is turned in a counterclockwise direction such that its indicating projection 45*c* is directed to the left side. With this arrangement, the hemispherical concave portion 39*g* of the switching shaft 39 is urged by the click spring 40 at a phase that coincides with the click steel ball 41 accommodated in the coupling body 37 to be positioned with a click sound. At this time, since the hole 39*b* of the switching shaft 39 coincides with an inner path 44*c* of the branching body 44, it is possible to send compressed air that flows in through the tube 36 from the hollow hole 39*a* of the switching shaft 39 up to the concave portion 44*b* on the left side as shown in FIG. 9. A thread inserting opening 48 is inserted into the concave portion 44*b* in a state in which upward air leakage is blocked by means of an O ring 49. The tip end of the thread inserting opening 48 is conical and includes a plurality of narrow grooves 48*b* on the conical portion. Accordingly, compressed air introduced to the concave portion 44*b* generates a flow of air of fast velocity upon passing the narrow grooves 48*b* such the upper looper thread 58 inserted from an upper end 48*c* of the thread inserting opening 48 is sucked to a thread hole 44*d* of the branching body 44 to be sent to the branching body pipe 54.

Figure 10:
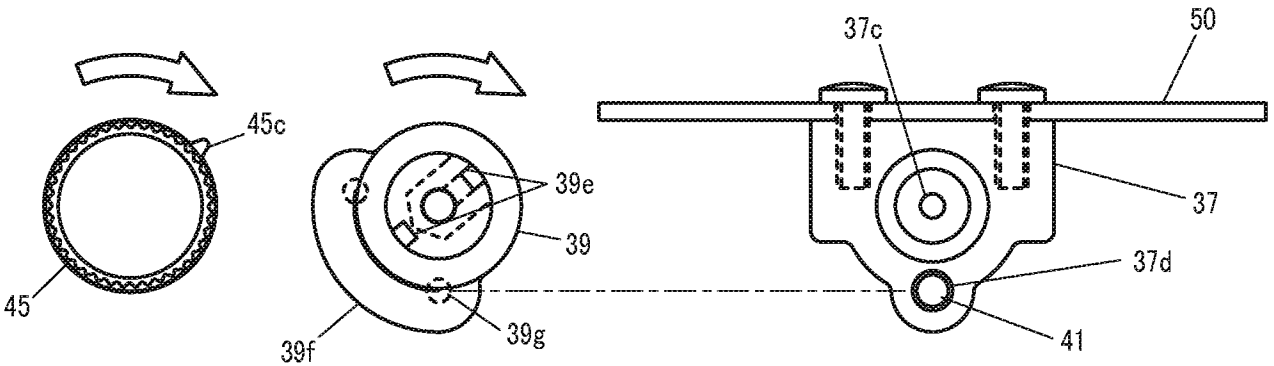
FIG. 10 A view showing a relationship of the coupling body 37, the switching shaft 39 and the looper selecting knob 45 in a state in which the looper selecting knob 45 is operated to a side of performing threading of a lower looper thread 59 (right side) (hereinafter referred to as "lower looper threading state").

FIG. 10 is a view showing a relationship of the coupling body 37, the switching shaft 39 and the looper selecting knob 45 in a state in which the looper selecting knob 45 is operated to a side of performing threading of a lower looper thread 59 (right side) (hereinafter referred to as "lower looper threading state").

Figure 11:
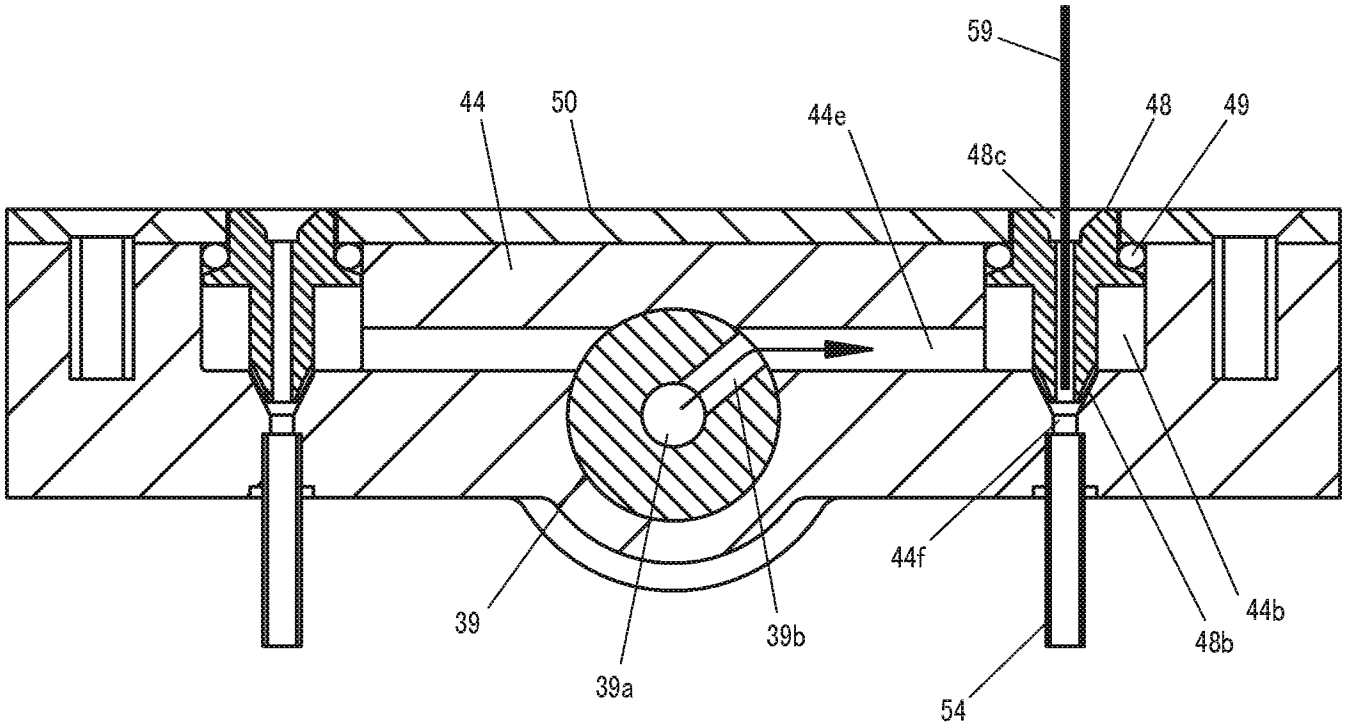
FIG. 11 A sectional view of the air flow path switching mechanism B cut at the position indicated by arrow E-E in FIG. 7 in the lower looper threading state.

FIG. 11 is a sectional view of the air flow path switching mechanism B cut at the position indicated by arrow E-E in FIG. 7 in the lower looper threading state.

For obtaining the lower looper threading state, the looper selecting knob 45 is turned in a clockwise direction such that its indicating projection 45*c* is directed to the right side. With this arrangement, the hemispherical concave portion 39*g* of the switching shaft 39 is urged by the click spring 40 at a phase that coincides with the click steel ball 41 accommodated in the coupling body 37 to be positioned with a click sound. At this time, since the hole 39*b* of the switching shaft 39 coincides with an inner path 44*e* of the branching body 44, it is possible to send compressed air that flows in through the tube 36 from the hollow hole 39*a* of the switching shaft 39 up to the concave portion 44*b* on the right side as shown in FIG. 11. Thereafter, the same operations as those of the above-described upper looper threading state are performed whereupon the lower looper thread 59 inserted from an upper end 48*c* of the thread inserting opening 48 is sucked to a thread hole 44*f* of the branching body 44 to be sent to the branching body pipe 54.

Returning to FIG. 1, in the overlock sewing machine according to the present embodiment having the above-described arrangement, the upper looper 1 and the lower looper 2 mutually intersect with needle threads (not shown) held by needles while respectively holding an upper looper thread and a lower looper thread to form seams.

The looper thread path C respectively couples the main shaft fixing mechanism D and the air flow switching mechanism B. When the main shaft fixing outer shaft 24 pierces through the main body of the sewing machine or the unit base 55 and fits with the notch 29*a* of the main shaft fixing plate 29 fixed to the main shaft 28, the loop thread path C sends the respective looper threads to the upper looper 1 or the lower looper 2 as set by the looper selecting knob 45 through compressed air that is send through the tube 36. The two branching body pipes 54 at a terminal end of the air flow switching mechanism B is coupled to a receiving opening 12*b* of the upper looper conduction pipe 12 and a receiving opening 13*b* of the lower looper conduction pipe 13 which are inlets on the looper thread path C side to communicate compressed air.

The phase at which the main shaft fixing outer shaft 24 and the notch 29*a* of the main shaft fixing plate 29 meet is set to be timing at which the upper looper receiving opening 1*a* and the lower looper receiving opening 2*a* coincide horizontally at the looper portion in FIG. 1 to reach an extension of the slide pipe 4.

Setting of the threading state and the sewing executing state is performed by either pressing the main shaft fixing outer shaft 24 to the main shaft fixing plate 29 side or pulling the same to the near side, and setting can be made by operating either the fixing lever knob 19 fixed at the main shaft fixing lever 18 up and down or by operating the thread take-up lever (not shown) (which rotates simultaneously with the main shaft) or by moving and operating the projecting knob portion 6*g* of the slide plate 6.

Next, switching operations between the threading state and the sewing executable state of the overlock sewing machine according to the present embodiment will be explained in details.

Figure 12A:
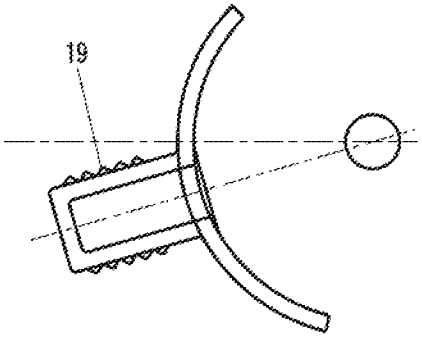
FIG. 12A A view showing the fixing lever knob 19 in a sewing executable state (threading cancelled state).

FIG. 12A is a view showing the fixing lever knob 19 in a sewing executable state (threading cancelled state).

Figure 12B:
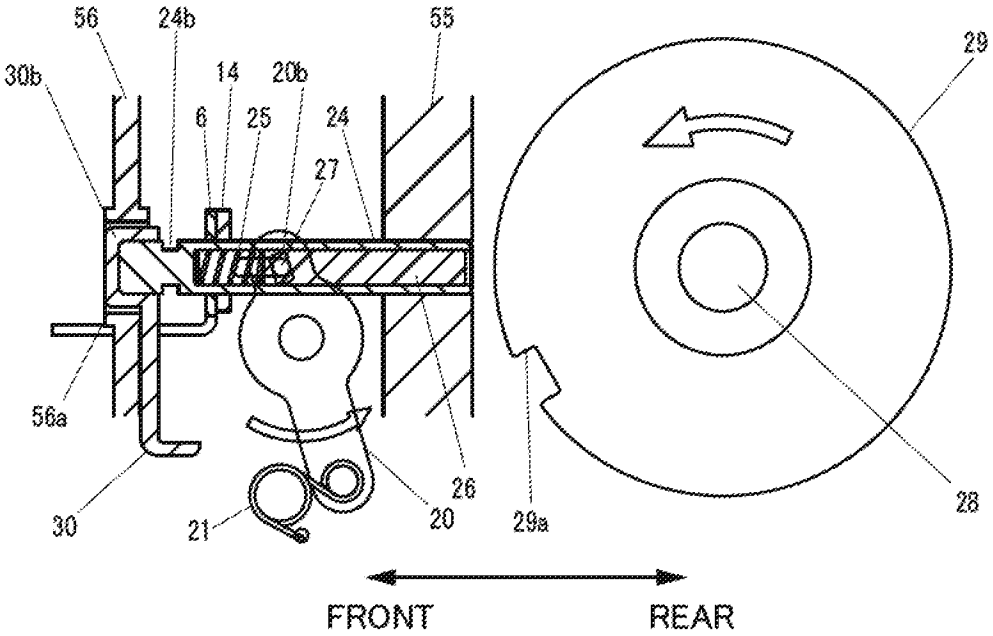
FIG. 12B A view showing a relationship of a main shaft fixing operating arm 20, a main shaft fixing outer shaft 24 and a main shaft fixing inner shaft 26 in the sewing executable state (threading cancelled state).

FIG. 12B is a view showing a relationship of a main shaft fixing operating arm 20, a main shaft fixing outer shaft 24 and a main shaft fixing inner shaft 26 in the sewing executable state (threading cancelled state).

Figure 12C:
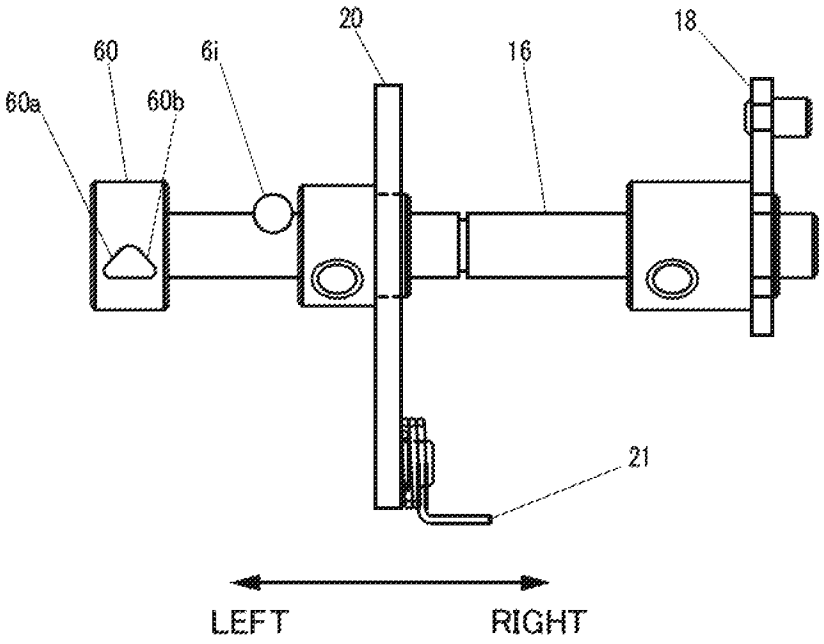
FIG. 12C A view showing behaviors of the main shaft fixing operating shaft 16 in the sewing executable state (threading cancelled state).

FIG. 12C is a view showing behaviors of the main shaft fixing operating shaft 16 in the sewing executable state (threading cancelled state).

Figure 12D:
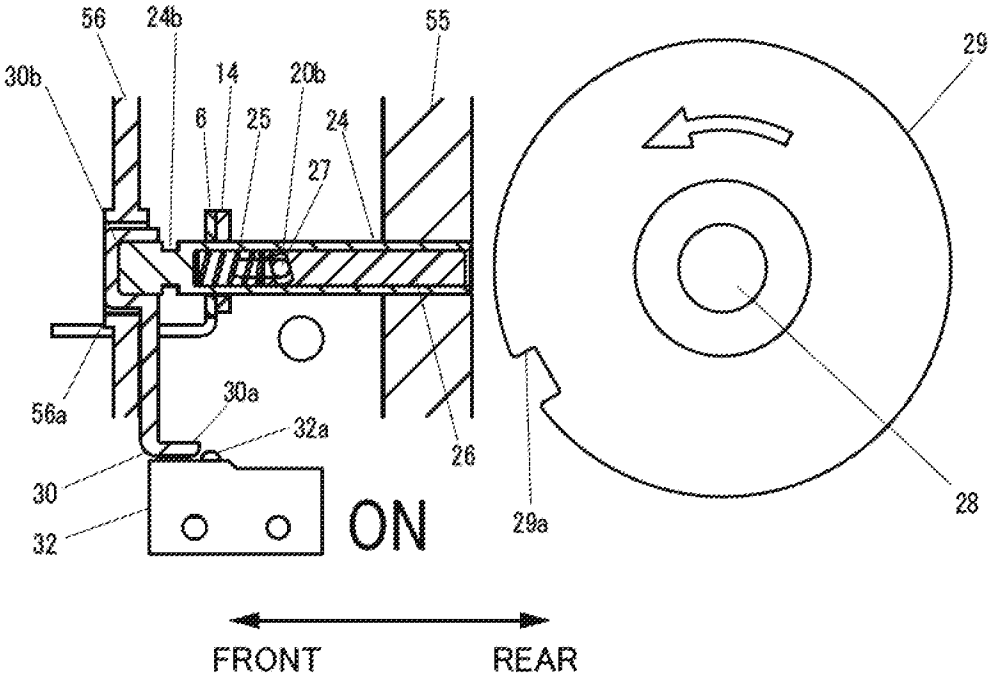
FIG. 12D A view showing a relationship between a motor switch cap 30 and a micro switch 32 in the sewing executable state (threading cancelled state).

FIG. 12D is a view showing a relationship between a motor switch cap 30 and a micro switch 32 in the sewing executable state (threading cancelled state).

Figure 12E:
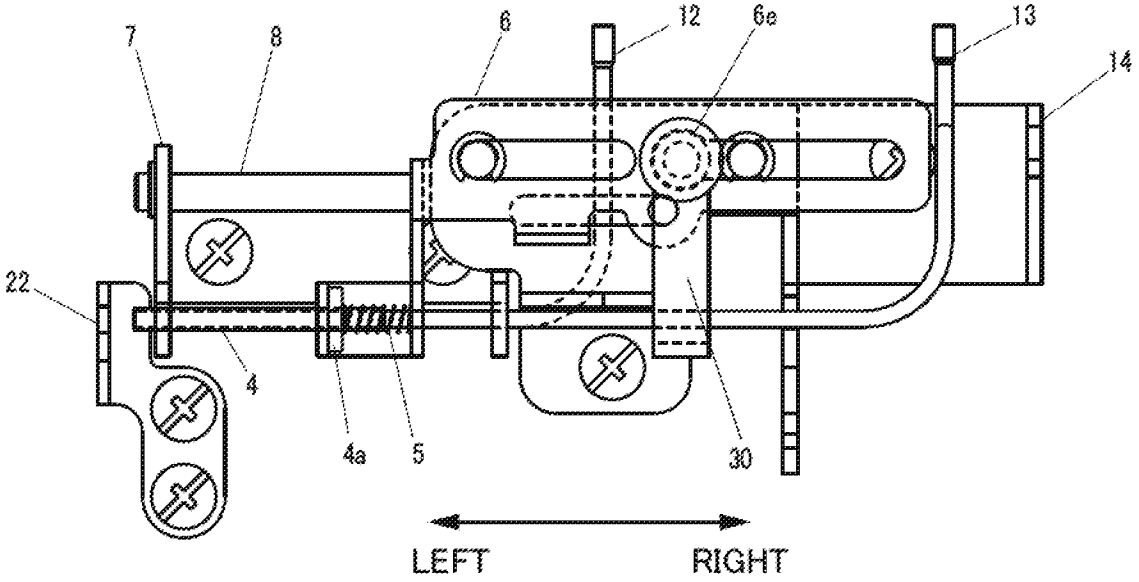
FIG. 12E A view showing positions of the slide plate 6 and a slide pipe 4 in the sewing executable state (threading cancelled state).

FIG. 12E is a view showing positions of the slide plate 6 and a slide pipe 4 in the sewing executable state (threading cancelled state).

In the sewing executable state (threading cancelled state), the fixing lever knob 19 is at a lowered position. Further, the main shaft fixing operating arm 20 is halted in a state in which it is rotated counterclockwise in FIG. 12B, and the main shaft fixing outer shaft 24 is pushed to the near side of the sewing machine by means of the fixing inner shaft pin 27. Accordingly, since the main shaft fixing outer shaft 24 does not fit with the notch 29*a* of the main shaft fixing plate 29, the main shaft 28 is rotatable.

Further, since the main shaft fixing outer shaft 24 has come to the near side, a boss portion 30*b* of the motor switch shaft 30 screwed to the main shaft fixing outer shaft 24 will be in a state in which it is exposed from an identification window 56*a* provided on a front surface cover 56 of the sewing machine. With this arrangement, the user can identify that the sewing machine is in a drivable state.

Moreover, since the motor switch cap 30 has come to the near side, a button 32*a* of the micro switch 32 is not pressed, and the motor driving source is in an ON state so that the sewing machine is drivable.

At this time, the slide plate 6 is positioned at a rightmost end and the large diameter portion 24*c* of the main shaft fixing outer shaft 24 and the wide hole portion 6*e* of the slide plate 6 fit with each other so that movements of the slide plate 6 in the left direction are restricted. Accompanying this, the slide pipe 4 is also held at a rightmost position. That is, the slide pipe 4 is in a state in which it is held in the sewing executable state.

Figure 13A:
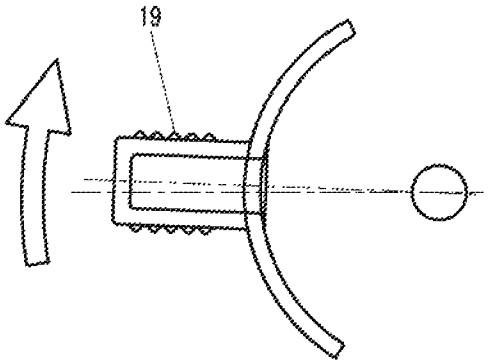
FIG. 13A A view showing a fixing lever knob 19 in a standby state for switching to threading.

FIG. 13A is a view showing the fixing lever knob 19 in a standby state for switching to threading.

Figure 13B:
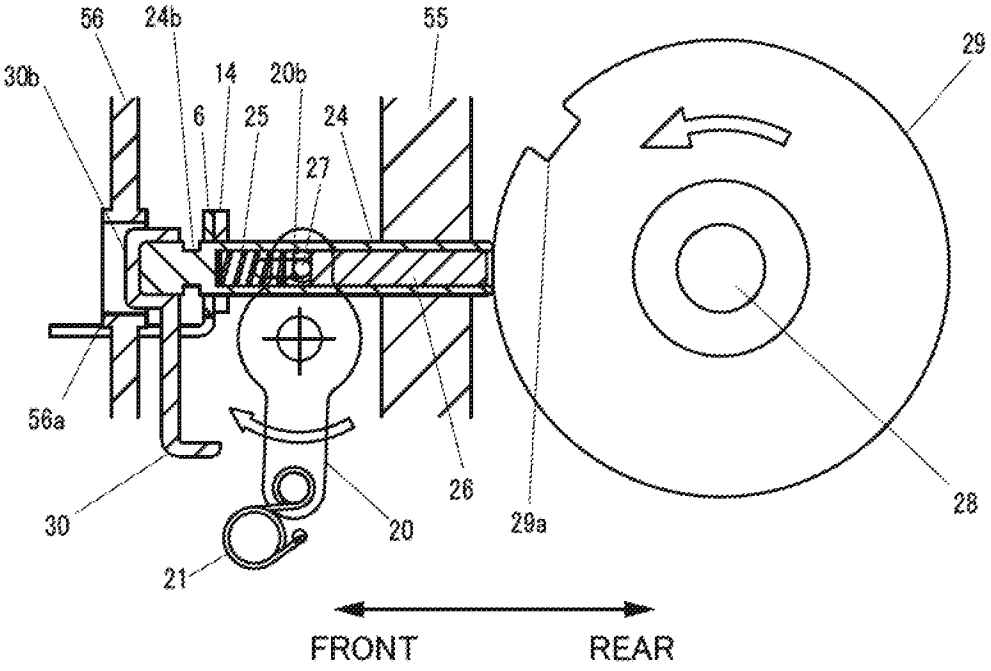
FIG. 13B A view showing a relationship of a main shaft fixing operating arm 20, a main shaft fixing outer shaft 24 and a main shaft fixing inner shaft 26 in the standby state for switching to threading.

FIG. 13B is a view showing a relationship of the main shaft fixing operating arm 20, the main shaft fixing outer shaft 24 and the main shaft fixing inner shaft 26 in the standby state for switching to threading.

Figure 13C:
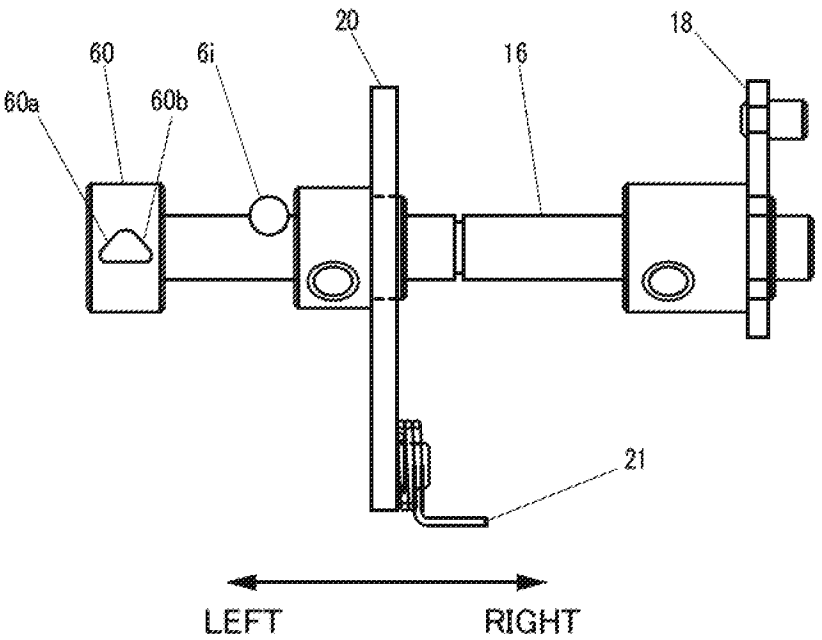
FIG. 13C A view showing behaviors of the main shaft fixing operating shaft 16 in the standby state for switching to threading.

FIG. 13C is a view showing behaviors of the main shaft fixing operating shaft 16 in the standby state for switching to threading.

Figure 13D:
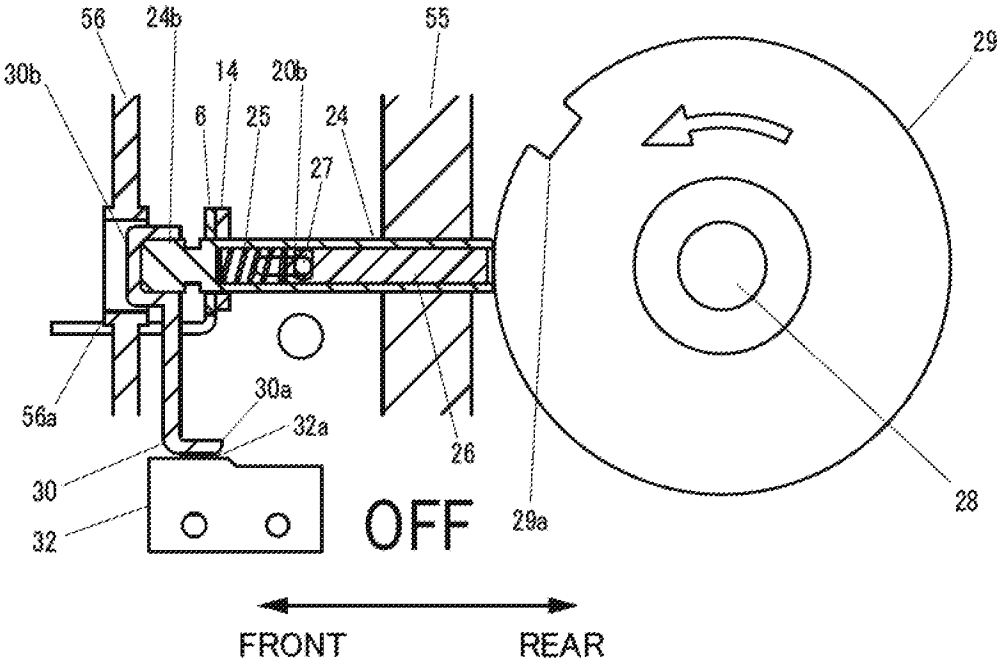
FIG. 13D A view showing a relationship between a motor switch cap 30 and a micro switch 32 in the standby state for switching to threading.

FIG. 13D is a view showing a relationship between the motor switch cap 30 and the micro switch 32 in the standby state for switching to threading.

Figure 13E:
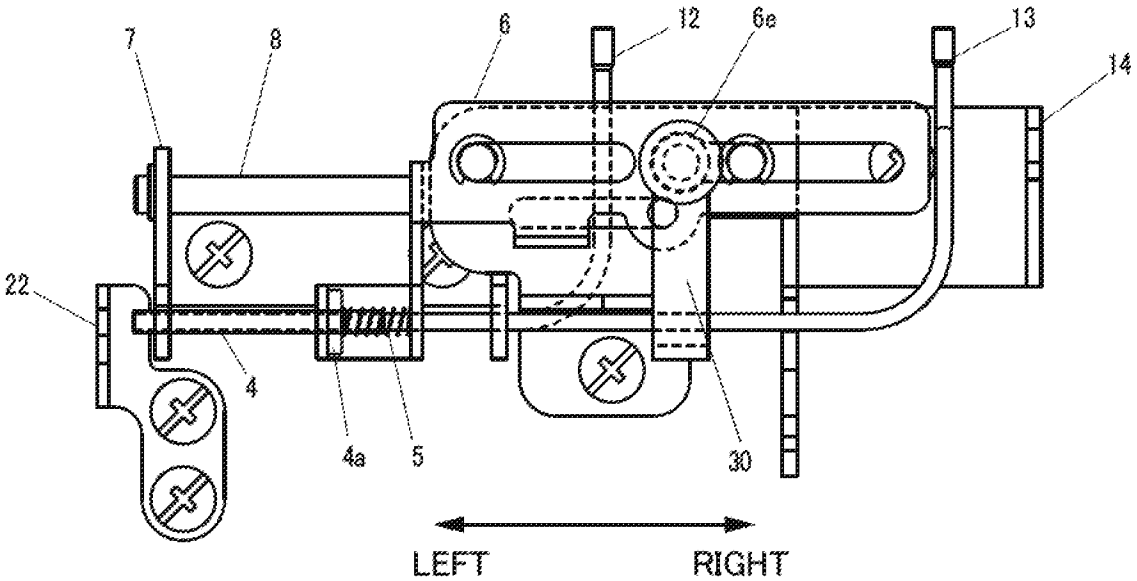
FIG. 13E A view showing positions of the slide plate 6 and a slide pipe 4 in the standby state for switching to threading.

FIG. 13E is a view showing positions of the slide plate 6 and the slide pipe 4 in the standby state for switching to threading.

The standby state for switching to threading is a standby state in which the fixing lever knob 19 is pressed upward for performing threading. By pressing the fixing lever knob 19 upward, the main shaft fixing operating arm 20 rotates in a clockwise direction in FIG. 13B. However, since the notch 29*a* of the main shaft fixing outer shaft 29 has not reached the phase at which it fits with the main shaft fixing outer shaft 24, the main shaft fixing outer shaft 24 abuts the outer periphery of the main shaft fixing plate 29 and is at a stop. However, the main shaft fixing operating spring 21 constantly urges the main shaft fixing outer shaft 24 by means of the main shaft fixing operating arm 20 and the fixing inner shaft pin 27 in a central axial direction of the main shaft fixing plate 29.

At this time, the switch contacting surface 30*a* of the motor switch cap 30 is in a state in which a button 32*a* of the micro switch 32 is pressed, that is, in which a motor driving power source is OFF. In this state, the motor will not operate even when a foot controller is stepped on for driving the motor.

The wide hole portion 6*e* of the slide plate 6 fits with the large diameter of the main shaft fixing outer shaft 24 so that it is impossible to move the slide plate 6 in a leftward direction in accordance with the urging force of the supporting plate shaft spring 10 so that the slide plate 6 and the slide pipe 4 are maintained at the current right position.

Figure 14A:
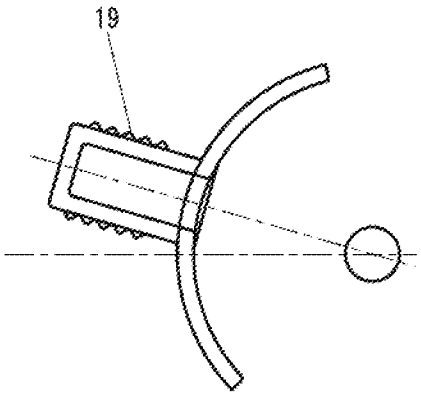
FIG. 14A A view showing the fixing lever knob 19 in a first step of operations for switching to threading.

FIG. 14A is a view showing the fixing lever knob 19 in a first step of operations for switching to threading.

Figure 14B:
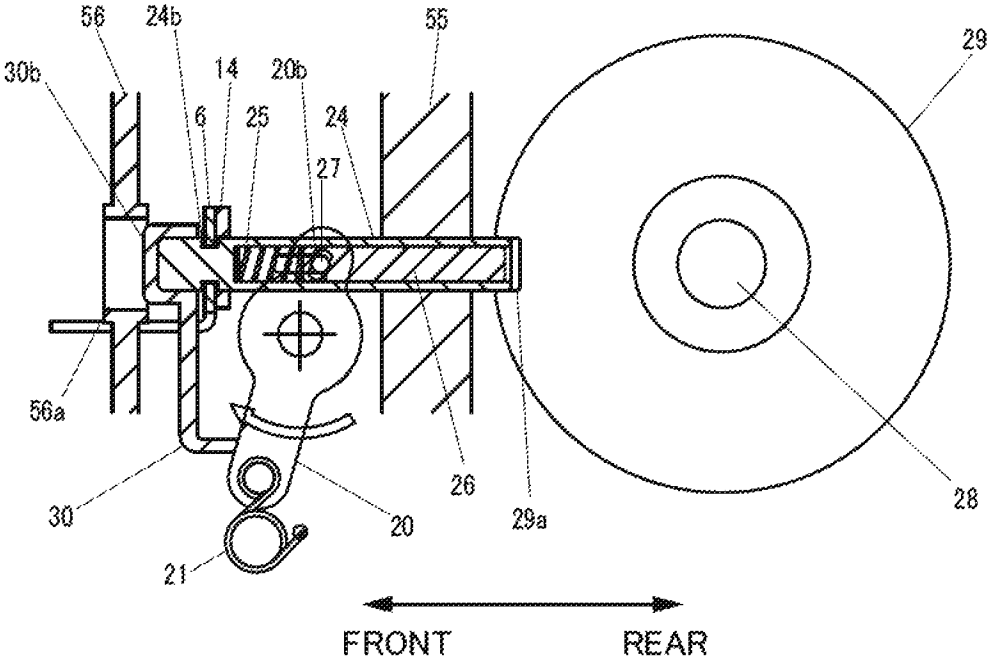
FIG. 14B A view showing a relationship of the main shaft fixing operating arm 20, the main shaft fixing outer shaft 24 and the main shaft fixing inner shaft 26 in the first step of operations for switching to threading.

FIG. 14B is a view showing a relationship of the main shaft fixing operating arm 20, the main shaft fixing outer shaft 24 and the main shaft fixing inner shaft 26 in the first step of operations for switching to threading.

Figure 14C:
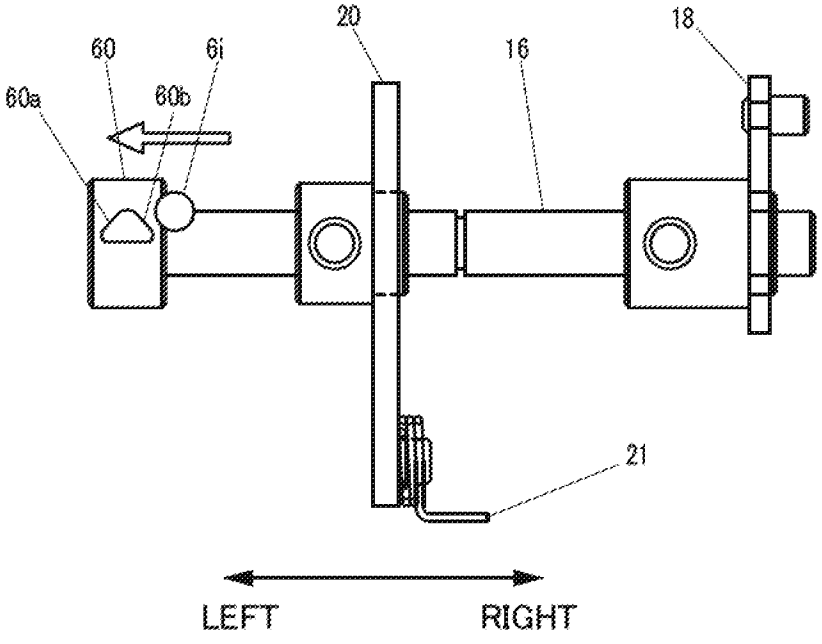
FIG. 14C A view showing behaviors of the main shaft fixing operating shaft 16 in the first step of operations for switching to threading.

FIG. 14C is a view showing behaviors of the main shaft fixing operating shaft 16 in the first step of operations for switching to threading.

Figure 14D:
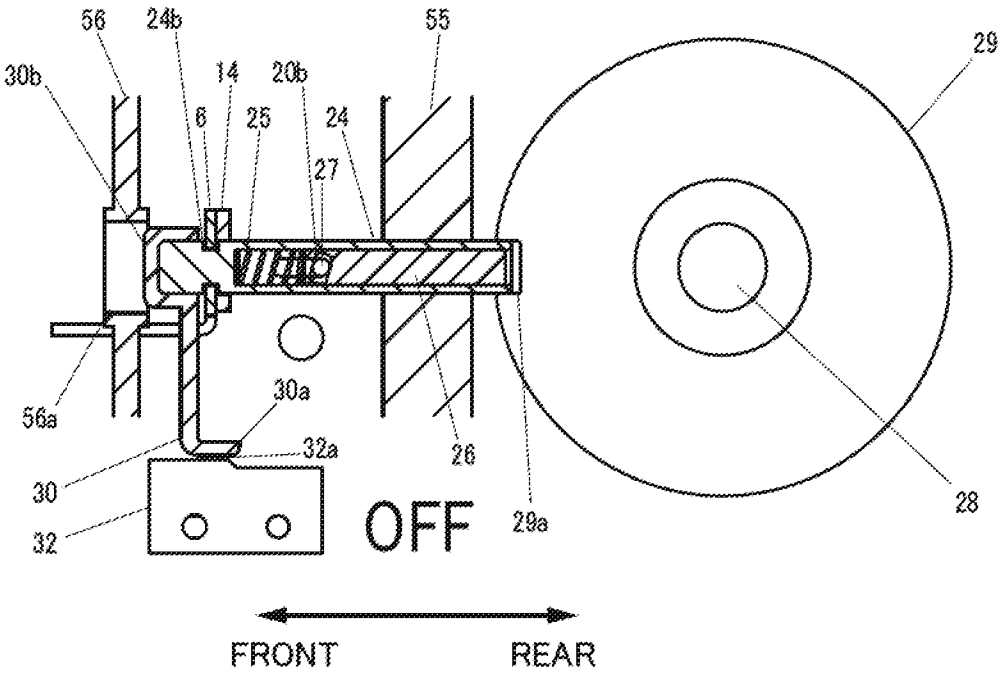
FIG. 14D A view showing a relationship between the motor switch cap 30 and the micro switch 32 in the first step of operations for switching to threading.

FIG. 14D is a view showing a relationship between the motor switch cap 30 and the micro switch 32 in the first step of operations for switching to threading.

Figure 14E:
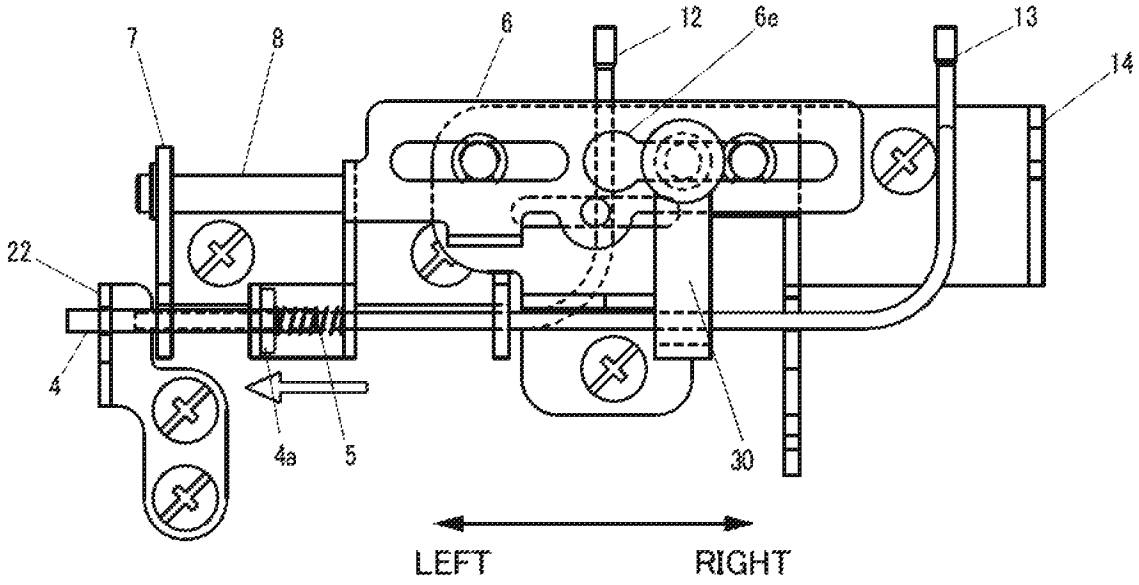
FIG. 14E A view showing positions of the slide plate 6 and the slide pipe 4 in the first step of operations for switching to threading.

FIG. 14E is a view showing positions of the slide plate 6 and the slide pipe 4 in the first step of operations for switching to threading.

Subsequently to the standby state for switching to threading (states of FIGS. 13A, 13B, 13C, 13D, 13E), when the thread take-up lever (not shown) is manually rotated to the near side, the main shaft fixing plate 29 rotates in accordance with the rotation of the main shaft 28. With this arrangement, the notch 29*a* of the main shaft fixing plate 29 reaches the phase at which the main shaft fixing outer shaft 24 stands by. At that moment, the main shaft fixing outer shaft 24 that had been urged in the central axial direction of the main shaft fixing plate 29 plunges into the notch 29*a* whereupon both members fit with each other (state of FIG. 14B).

Since the main shaft fixing outer shaft 24 is continuously urged in the central axial direction of the main shaft fixing plate 29 through the action of the main shaft fixing operating spring 21, the fitting of both members is continued. Since the main shaft fixing outer shaft 24 has moved rearward, the small diameter portion 24*b* of the main shaft fixing outer shaft 24 and the long hole portion 6*f* of the slide plate 6 coincide so that the slide plate 6 moves in a left direction through the urging force of the supporting plate shaft spring 10. Accompanying this, the two slide pipes 4 also move in the left direction and the left ends of the slide pipes 4 pierce through the round holes 23*a*, 23*b* of the looper thread take-up guide 23. The micro switch 32 continuously maintains a state in which the motor driving power source is OFF.

Figure 15A:
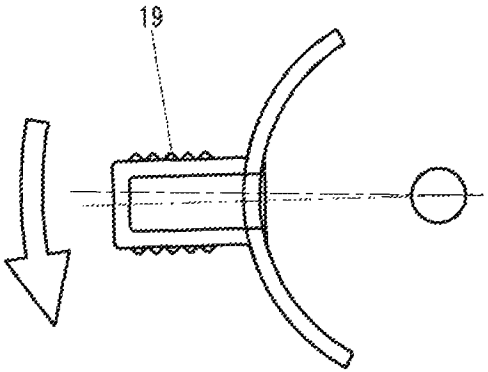
FIG. 15A A view showing the fixing lever knob 19 in a second step of operations for switching to threading.

FIG. 15A is a view showing the fixing lever knob 19 in a second step of switching operations to threading.

Figure 15B:
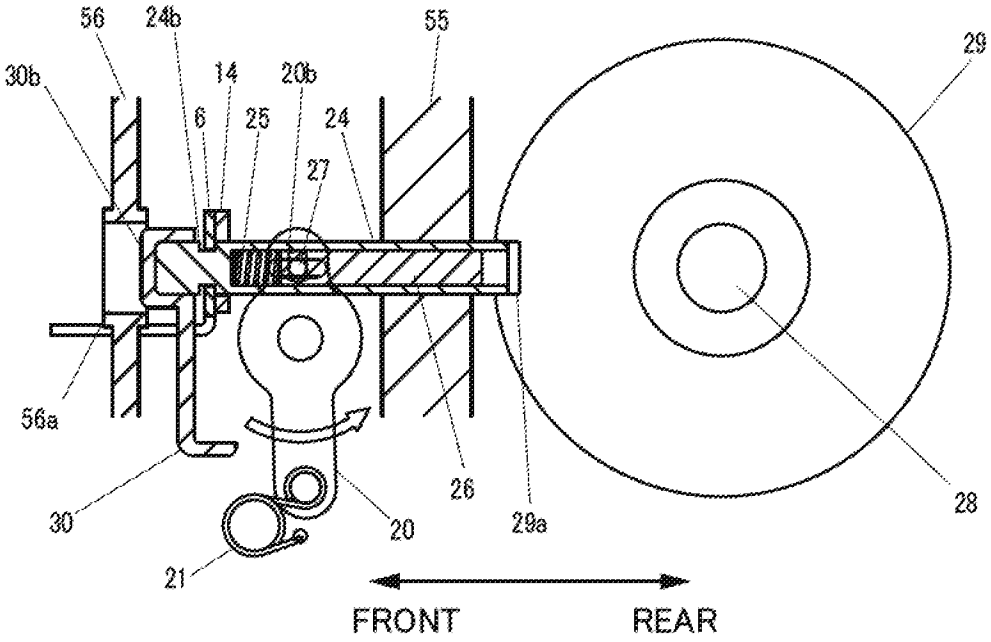
FIG. 15B A view showing a relationship of the main shaft fixing operating arm 20, the main shaft fixing outer shaft 24 and the main shaft fixing inner shaft 26 in the second step of operations for switching to threading.

FIG. 15B is a view showing a relationship of the main shaft fixing operating arm 20, the main shaft fixing outer shaft 24 and the main shaft fixing inner shaft 26 in the second step of operations for switching to threading.

Figure 15C:
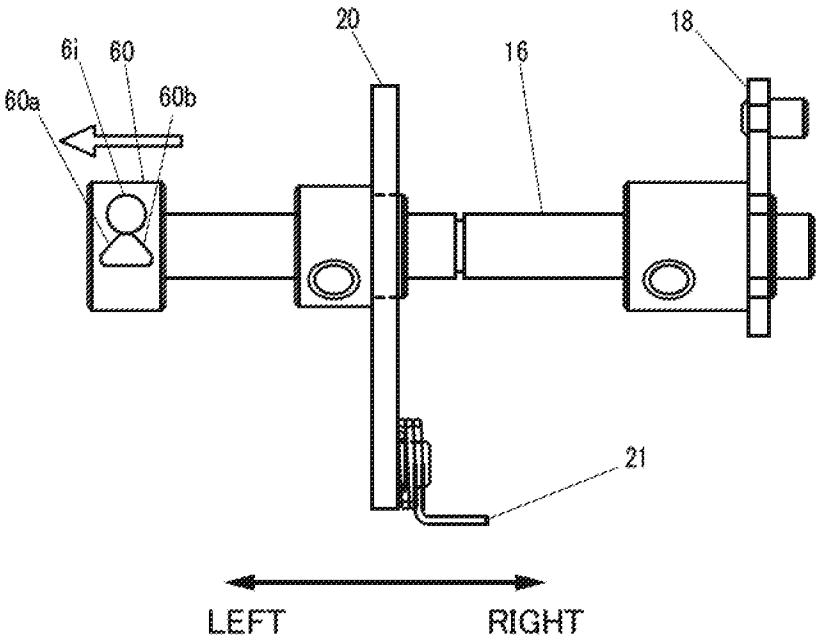
FIG. 15C A view showing behaviors of the main shaft fixing operating shaft 16 in the second step of operations for switching to threading.

FIG. 15C is a view showing behaviors of the main shaft fixing operating shaft 16 in the second step of operations for switching to threading.

Figure 15D:
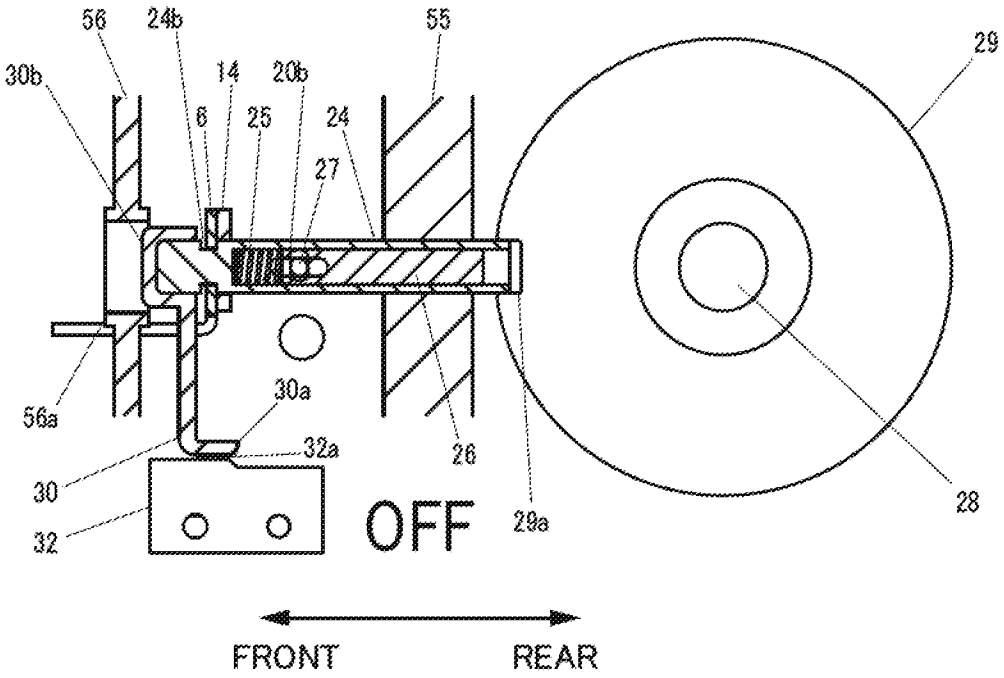
FIG. 15D A view showing a relationship between the motor switch cap 30 and the micro switch 32 in the second step of operations for switching to threading.

FIG. 15D is a view showing a relationship between the motor switch cap 30 and the micro switch 32 in the second step of operations for switching to threading.

Figure 15E:
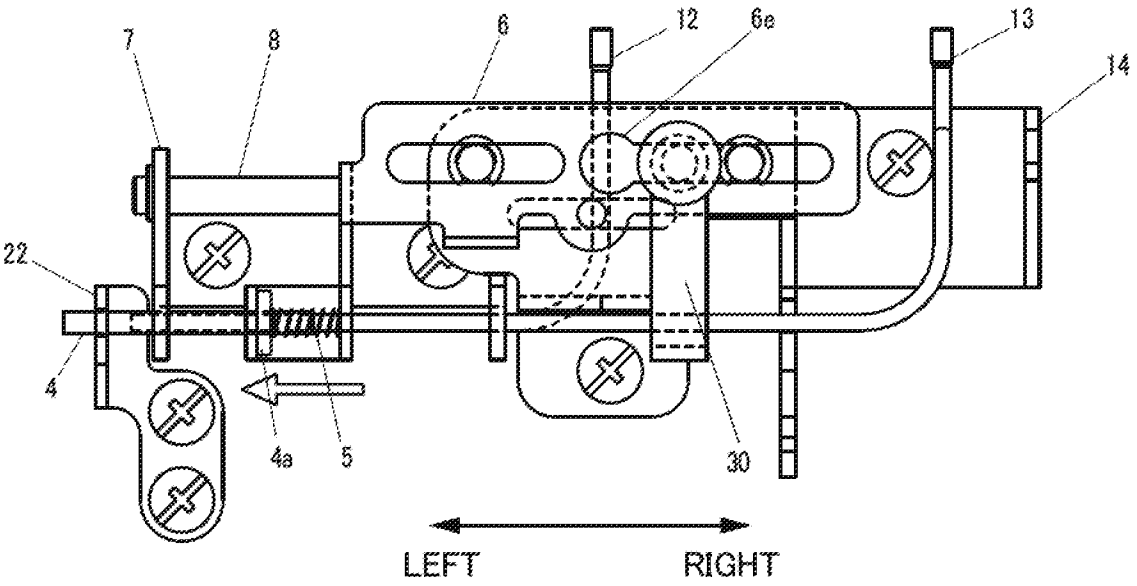
FIG. 15E A view showing positions of the slide plate 6 and the slide pipe 4 in the second step of operations for switching to threading.

FIG. 15E is a view showing positions of the slide plate 6 and the slide pipe 4 in the second step of operations for switching to threading.

Accompanying the slide plate 6 moving to the left in succession with the first step of operations for switching to threading (state of FIG. 14A, 14B, 14C, 14D, 14E), the slide plate pin 6*i* integrally moves to the left as well. At this time, the switching cam ring 60 provided at the left end of the main shaft fixing operating shaft 16 and the slide plate pin 6*i* intersect with each other.

The switching cam ring 60 is pressed down counterclockwise in FIG. 15B by means of the slide plate pin 6*i* that plunged to the right slope 60*b* of the switching cam ring 60 that had reached a topmost point clockwise in FIG. 15B together with the fixing lever knob 19. Similarly, the main shaft fixing operating arm 20 also rotates counterclockwise in FIG. 15B by means of the main shaft fixing operating shaft 16 to exceed the neutral point of the main shaft fixing operating spring 21.

By the rotation of the main shaft fixing operating arm 20, the fixing inner shaft pin 27 is pushed to the near side. However, the main shaft fixing outer shaft 24 cannot move to the near side since the small diameter portion 24*b* thereof fits with the long hole portion 6*f* of the slide plate 6 and is absorbed by compressing the fixing inner shaft spring 25. In this manner, since the main shaft fixing outer shaft 24 cannot move to the front side, the main shaft fixing outer shaft 24 and the notch 29*a* of the main shaft fixing plate 29 maintain the fitted state. The micro switch 32 continuously maintains the state in which the motor driving power source is OFF as well.

Figure 16A:
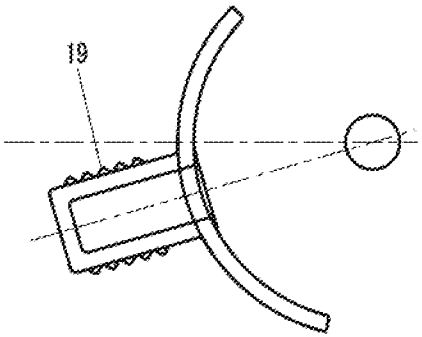
FIG. 16A A view showing the fixing lever knob 19 in a threading enabled state.

FIG. 16A is a view showing the fixing lever knob 19 in a threading enabled state.

Figure 16B:
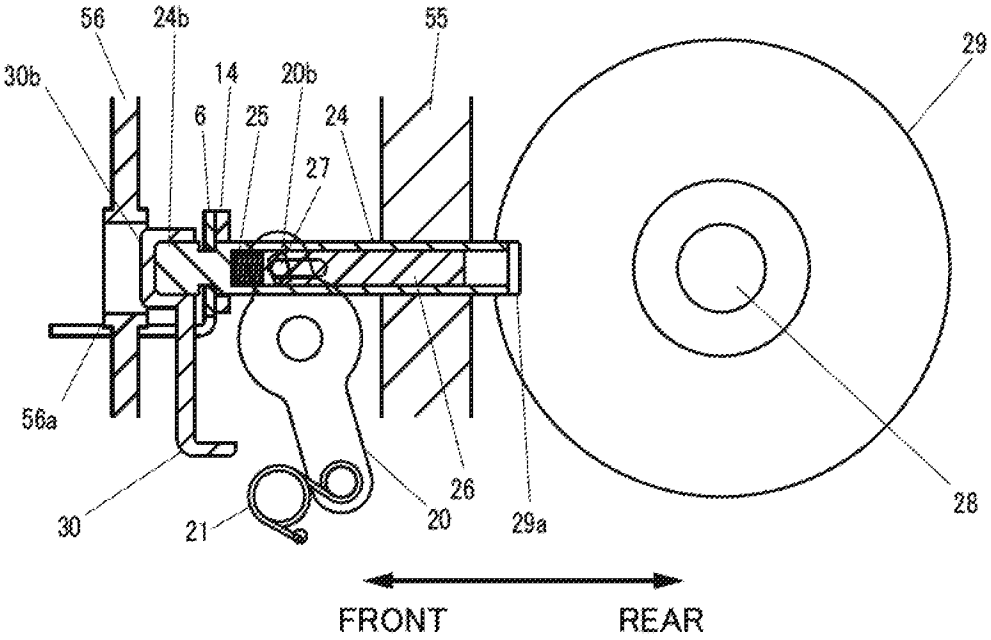
FIG. 16B A view showing a relationship of the main shaft fixing operating arm 20, the main shaft fixing outer shaft 24 and the main shaft fixing inner shaft 26 in the threading enabled state.

FIG. 16B is a view showing a relationship of the main shaft fixing operating arm 20, the main shaft fixing outer shaft 24 and the main shaft fixing inner shaft 26 in the threading enabled stated.

Figure 16C:
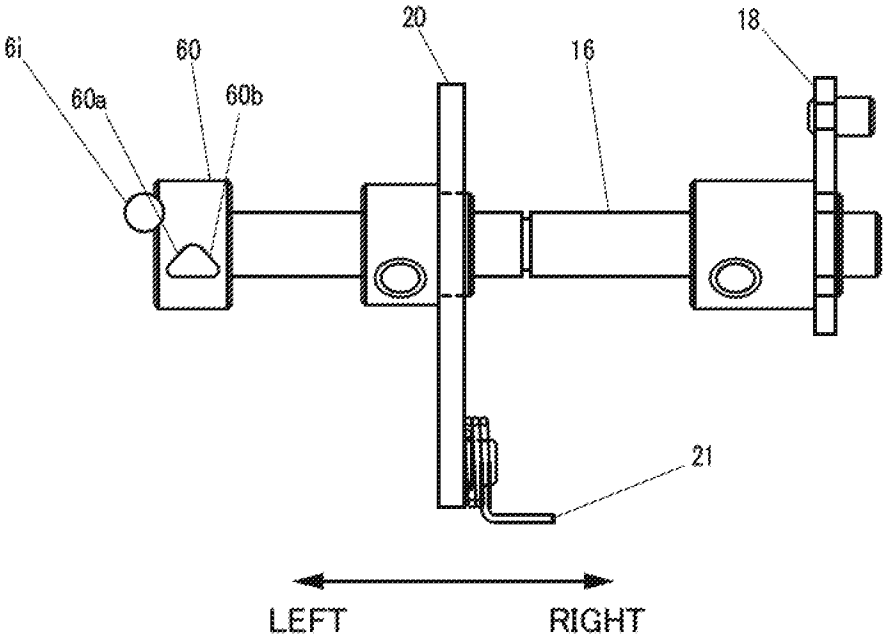
FIG. 16C A view showing behaviors of the main shaft fixing operating shaft 16 in the threading enabled state.

FIG. 16C is a view showing behaviors of the main shaft fixing operating shaft 16 in the threading enabled state.

Figure 16D:
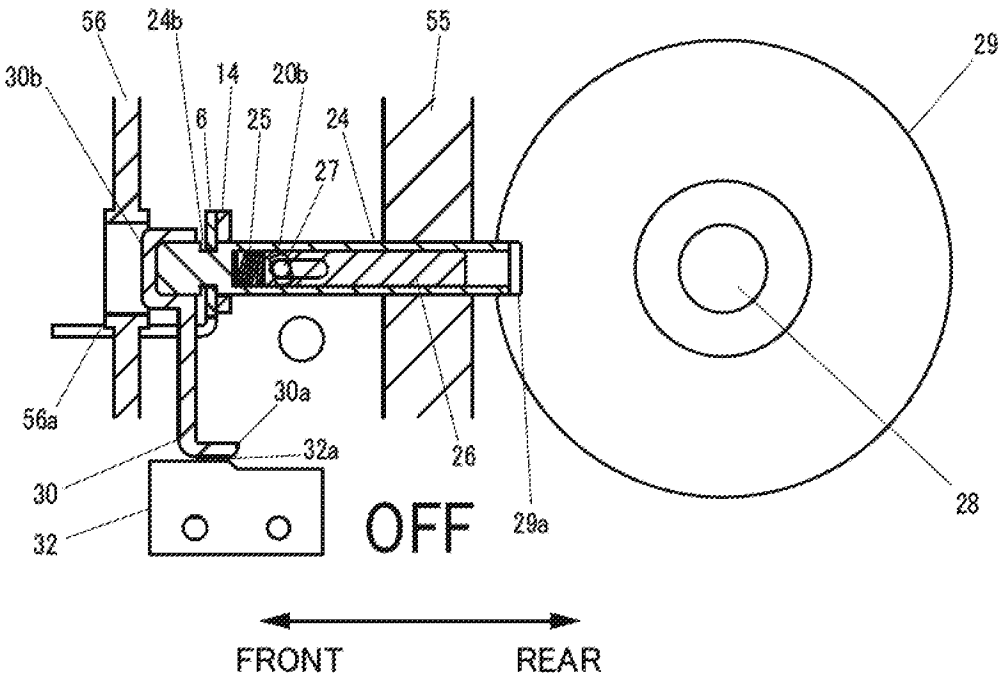
FIG. 16D A view showing a relationship between the motor switch cap 30 and the micro switch 32 in the threading enabled state.

FIG. 16D is a view showing a relationship between the motor switch cap 30 and the micro switch 32 in the threading enabled state.

Figure 16E:
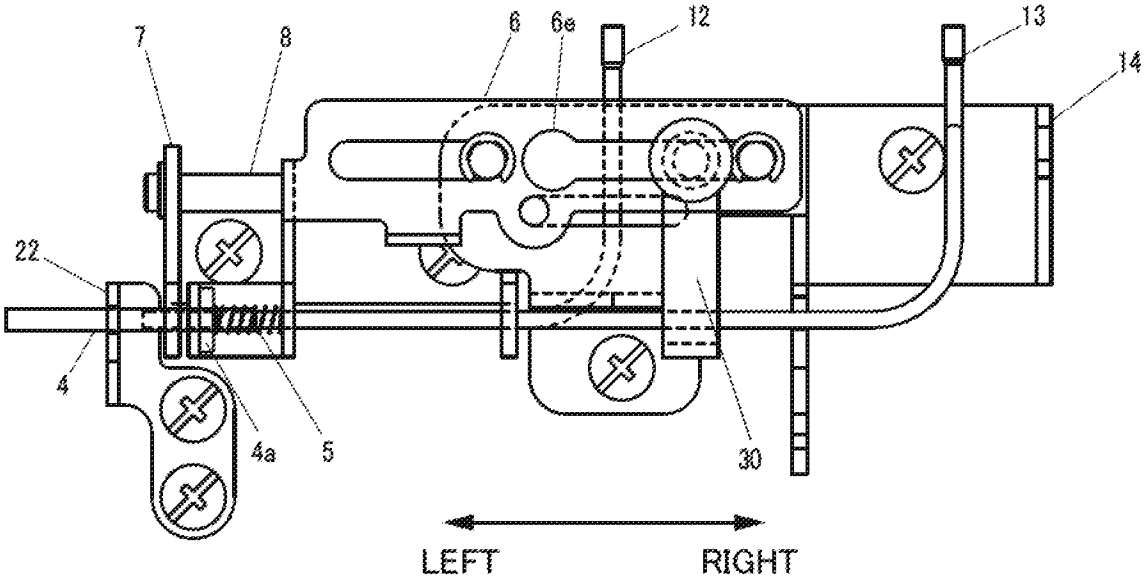
FIG. 16E A view showing positions of the slide plate 6 and the slide pipe 4 in the threading enabled state.

FIG. 16E is a view showing positions of the slide plate 6 and the slide pipe 4 in the threading enabled state.

The slide plate 6 reaches the left end and halts in succession with the second step of operations for switching to threading (state of FIG. 15A, 15B, 15C, 15D, 15E). In accordance therewith, the slide pipe 4 first pierces through the looper thread take-up guide 23, then pierces through the upper looper thread hole 3*a* and the lower looper thread hole 3*b* of the looper thread take-up 3 to reach the upper looper receiving opening 1*a* and the lower looper receiving opening 2*a*, respectively.

The upper looper receiving opening 1*a* and left end of the slide pipe 4 as well as the lower looper receiving opening 2*a* and the left end of the slide pipe 4 are urged by the slide pipe spring 5 in more closely adhering directions and are coupled to make the flow of compressed air and the flow of the respective looper threads accompanying the same smoother.

At this time, the switch contacting surface 30*a* of the motor switch cap 30 continuously keeps on pressing the button 32*a* of the micro switch 32 and the motor driving power source is in the OFF state.

Figure 17A:
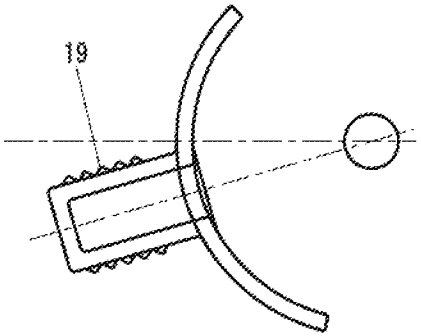
FIG. 17A A view showing the fixing lever knob 19 in an operating state for cancelling threading.

FIG. 17A is a view showing the fixing lever knob 19 in an operating state for cancelling threading.

Figure 17B:
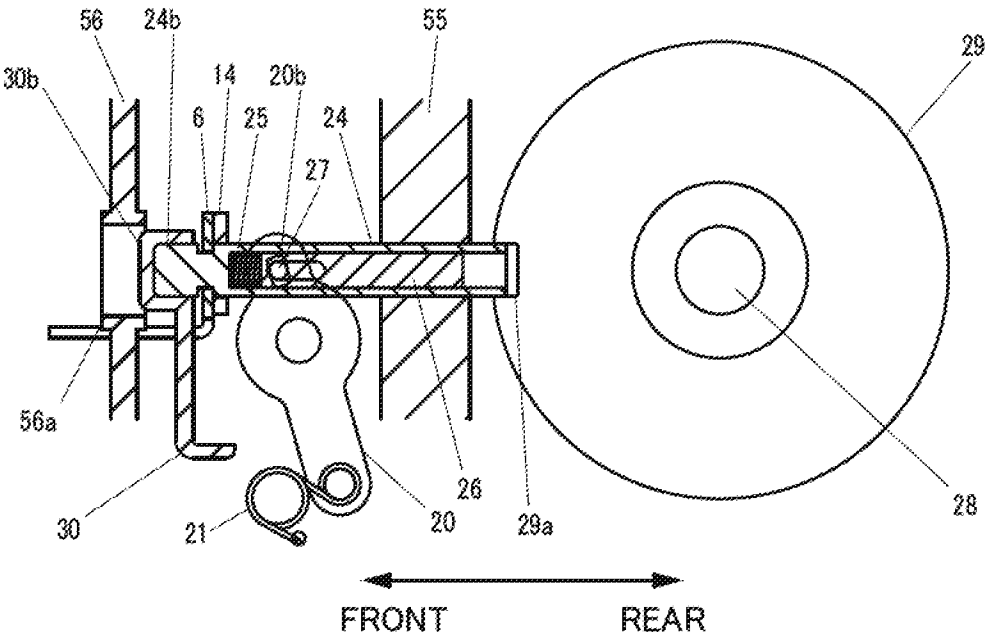
FIG. 17B A view showing a relationship of the main shaft fixing operating arm 20, the main shaft fixing outer shaft 24 and the main shaft fixing inner shaft 26 in the operating state for cancelling threading.

FIG. 17B is view showing a relationship of the main shaft fixing operating arm 20, the main shaft fixing outer shaft 24 and the main shaft fixing inner shaft 26 in the operating state for cancelling threading.

Figure 17C:
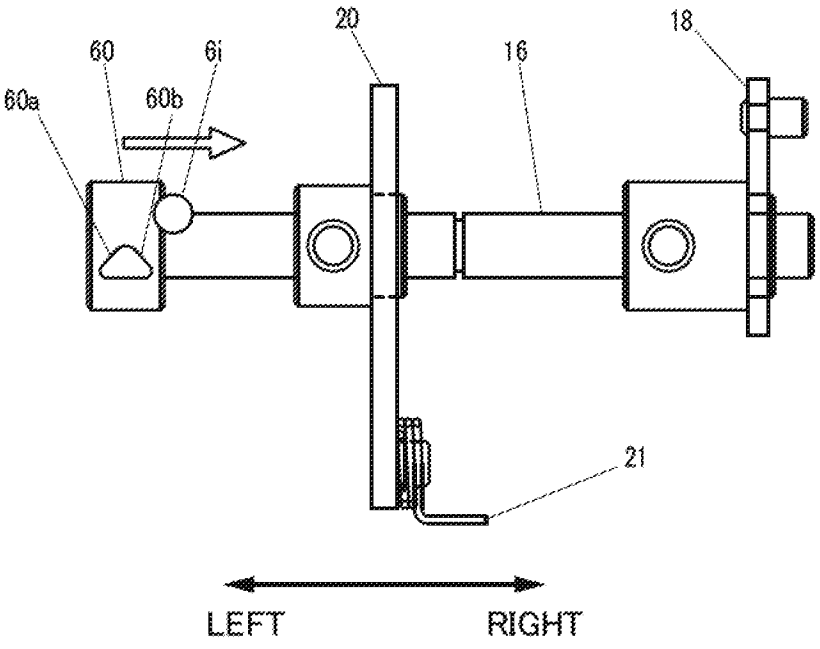
FIG. 17C A view showing behaviors of the main shaft fixing operating shaft 16 in the operating state for cancelling threading.

FIG. 17C is a view showing behaviors of the main shaft fixing operating shaft 16 in the operating state for cancelling threading.

Figure 17D:
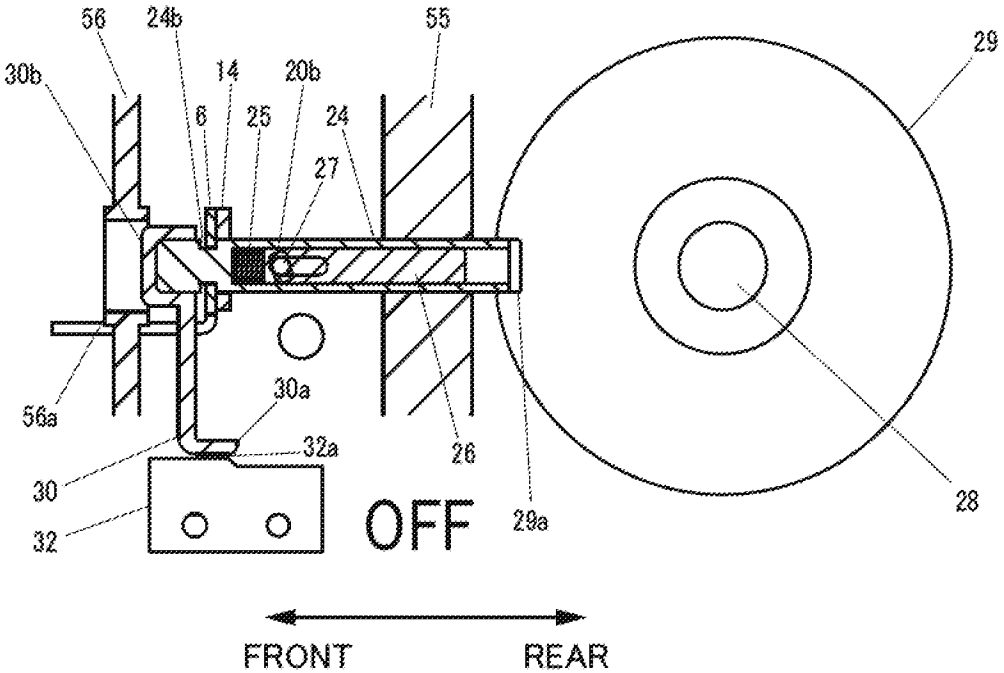
FIG. 17D A view showing a relationship between the motor switch cap 30 and the micro switch 32 in the operating state for cancelling threading.

FIG. 17D is a view showing a relationship between the motor switch cap 30 and the micro switch 32 in the operating state for cancelling threading.

Figure 17E:
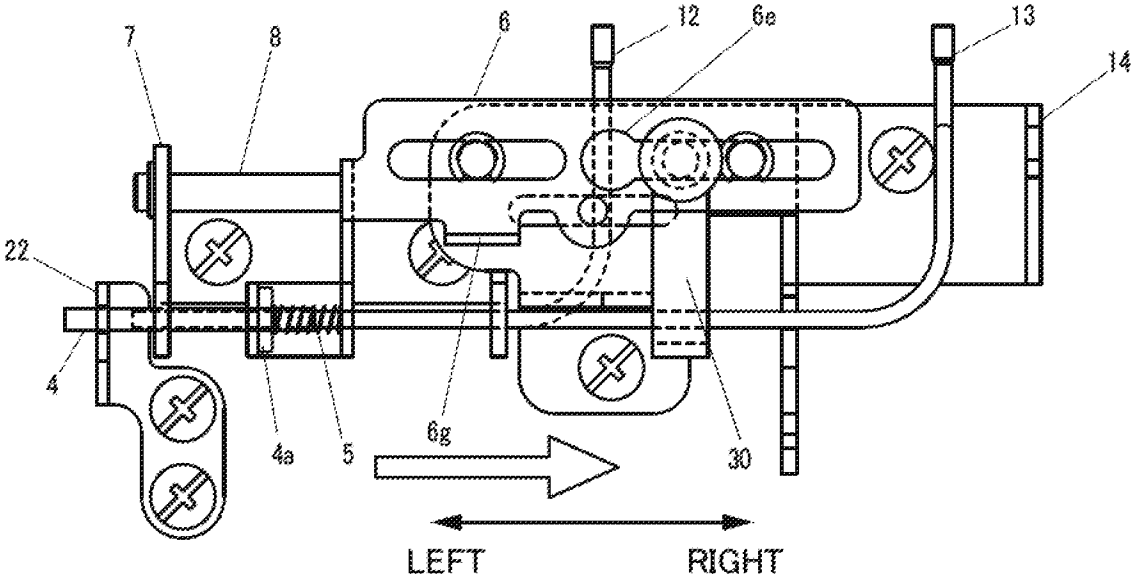
FIG. 17E A view showing positions of the slide plate 6 and the slide pipe 4 in the operating state for cancelling threading.

FIG. 17E is a view showing positions of the slide plate 6 and the slide pipe 4 in the operating state for cancelling threading.

Upon completion of threading in the threading enabled state (state of FIG. 16A, 16B, 16C, 16D, 16E), when the projecting knob portion 6*g* of the slide plate 6 is pinched to move the slide plate 6 in the right direction for cancelling threading, the wide hole portion 6*e* of the slide plate 6 reaches a position at which it coincides with the main shaft fixing outer shaft 24. At that moment, the main shaft fixing outer shaft 24 that had been urged to the near side by the fixing inner shaft spring 25 projects to the near side.

With this arrangement, the sewing machine will return to the sewing executable state (threading cancelled state) (state of FIG. 12A, 12B, 12C, 12D, 12E)

With the main shaft fixing outer shaft 24 projecting to the near side, the large diameter portion of the main shaft fixing outer shaft 24 and the wide hole portion 6*e* of the slide plate 6 fit with each other so that the slide plate 6 remains at the current position against the urging force of the supporting plate shaft spring 10. The two slide pipes 4 similarly move to the right side and remain as they are. Moreover, the main shaft fixing outer shaft 24 moves to the near side so that the motor switch cap 30 also moves to the near side, and the micro switch 32 will be in a state in which the motor driving power source is ON.

Here, normal operations are secured even when the fixing lever knob 19 is erroneously pushed up to rotate and move the main shaft fixing operating arm 20 and the switching cam ring 60 clockwise in the threading enabled state (state of FIG. 16A, 16B, 16C, 16D, 16E). That is, when the projecting knob portion 6*g* of the slide plate 6 is pinched and moved in a right direction in the state of operations for cancelling threading (state of FIG. 17A, 17B, 17C, 17D, 17E), the slide plate pin 6*i* presses the left slope 60*a* of the switching cam ring 60 in to repeatedly rotate and move the switching cam ring 60 and the main shaft fixing operating arm 20 in the counterclockwise direction, and it is possible to return to normal operations.

As explained so far, according to the overlock sewing machine of the present embodiment, switching between the threading enabled state and the sewing executable state is enabled through one hand operation by means of a lever for switching (main shaft fixing lever 18, fixing lever knob 19) or by means of the thread take-up lever and the projecting knob portion 6*g* of the slide plate 6, respectively. Further, with the slide plate pin 6*i* pushing the right slope 60*b* of the switching cam ring 60, the lever for switching (main shaft fixing lever 18, fixing lever knob 19) is automatically pressed down (pressed down counterclockwise in FIG. 15A, 15B). Accordingly, steps for operating the lever for switching can be reduced so that switching operations can be performed more easily.

The operation using the lever is an operation of exceeding the neutral point of the urging force of the main shaft fixing operating spring 21 for changing the direction of action of the urging force of the main shaft fixing operating spring 21 which can be smoothly operated causing no extreme load changes.

Further, the operational feeling of this action using the lever is favorable in view of the point that when the neutral point is exceeded, the main shaft fixing lever 18 and the fixing lever knob 19 automatically rotate through the urging force of the main shaft fixing operating spring 21 to move to specified positions. Such favorable operational feelings according to the present invention cannot be obtained by means of the prior art in which grooved cams are used for making the main shaft fixing outer shaft 24 and other members move directly and forcibly.

Still further, in a method of using a conventional grooved cam, the operating force amount could not be reduced without making operation strokes longer so that increases in size were inevitable. In contrast thereto, in the present invention, the operating force amount can be changed by merely changing the ratio of the lever arm length, the degree of freedom of design in view of setting the operating force amount and the arrangement of the fixing lever knob 19 is high, and it is possible to provide an overlock sewing machine of small size and favorable operational feeling.

Moreover, the overlock sewing machine according to the present embodiment comprises the identification window 56*a* through which the threading enabled state and the sewing executable state can be identified at a glance and a safety device (motor switch cap 30, micro switch 32) enabling/disabling motor driving interconnected therewith so that it is very safe and easy to use.

Modified Embodiment

The present invention is not limited to the above explained embodiment but various modifications and changes are possible which are also included in the present invention.

(1) In the present embodiment, the relationship between the main shaft fixing outer shaft 24 as the first shaft and the main shaft fixing inner shaft 26 as the second shaft has been explained while citing an example in which the second shaft side is located inside. The present invention is not limited to this arrangement, and it can be arranged in that the first shaft side is inside and the second shaft side is outside. Further, the invention is not limited to an embodiment in which one shaft is inserted into the interior of the other shaft, but any arrangement in which both members are relatively movable in an axial direction would do, and any embodiment including, for instance, a case in which a rail-like guide portion is provided, would do.

(2) In the present embodiment, explanations have been made citing a case in which the fixing inner shaft pin 27 as a shaft pin is provided at the main shaft fixing inner shaft 26 as the second shaft. The present invention is not limited to this arrangement, and the shaft pin might, for instance, be provided on the rocking lever portion side. In this case, it is preferable to provide a long hole shape or the like on the second shaft for enabling movements of the second shaft even when the shaft pin moves in an arc-like shape.

In this respect, while the embodiment and the modified embodiments can be used upon suitably combining them, detailed explanations will be omitted. The present invention is not to be limited by the above explained respective embodiments.

EXPLANATION OF THE REFERENCE NUMBERS

A looper portion
B air flow path switching mechanism
C looper thread path
D main shaft fixing mechanism
1 upper looper
1*a* upper looper receiving opening
1*b* pipe-like member
1*c* upper looper point
2 lower looper
2*a* lower looper receiving opening
2*b* pipe-like member
2*c* lower looper point
3 looper thread take-up
3*a* upper looper thread hole
3*b* lower looper thread hole
4 slide pipe
4*a* flange portion
5 slide pipe spring
6 slide plate (slide member)
6*a* U groove
6*b*, 6*c* round hole
6*d* long hole
6*e* wide hole portion
6*f* long hole portion
6*g* projecting knob portion
6*h* heteromorphic long hole
6*i* slide plate pin (abutting portion)
7 looper pipe supporting plate
7*a*, 7*b* through hole
7*c*, 7*e* right-side surface hole
7*d*, 7*f* left-side surface hole
8 supporting plate shaft
9, 15, 17 E-shaped snap ring
10 supporting plate shaft spring
12 upper looper conduction pipe
12*a* linear portion
12*b* receiving opening
13 lower looper conduction pipe
13*a* linear portion
13*b* receiving opening
14 sliding plate support
14*a* pin with E-grooves
14*b* round hole
14*c*, 14*d* through hole
14*e* arc-shaped long hole
14*f* small hole
14*g* long hole
16 main shaft fixing operating shaft
18 main shaft fixing lever
18*a* arm (main shaft fixing lever portion)
18*b* pin
19 fixing lever knob
20 main shaft fixing operating arm (main shaft fixing operating arm portion)
20*a* pin
20*b* shaft pin engaging portion
21 main shaft fixing operating spring
23 looper thread take-up guide
23*a*, 23*b* round hole
24 main shaft fixing outer shaft (first shaft)
24*a* side surface long hole (engaging portion)
24*b* small diameter portion
24*c* large diameter portion
25 fixing inner shaft spring (shaft spring)
26 main shaft fixing inner shaft (second shaft)
28 fixing inner shaft pin (shaft pin)
28 main shaft
29 main shaft fixing plate
29*a* notch
30 motor switch cap (identification member)
30*a* switch contacting surface
30*b* boss portion
32 micro switch
32*a* button
33 switch mounting plate
36 tube
37 coupling body

37*a*, 37*b* hollow boss
37*c* hollow hole
37*d* concave portion
38, 43, 49 O ring
39 switching shaft
39*a* hollow hole
39*b* hole
39*c* angular shaft
39*d* central hole
39*e* angular groove
39*f* flange
39*g* hemispherical concave portion
40 click spring
41 click steel ball
42 hexagonal nut
44 branching body
44*a* central hole
44*b* concave portion
44*c* inner path
44*d* thread hole
44*e* inner path
44*f* thread hole
45 looper selecting knob
45*a* angular projection
45*b* central through hole
45*c* indicating projection
11, 22, 31, 34, 35, 46, 51, 52, 53, 57 screw
47 cap
48 thread inserting opening
48*a* upper portion boss
48*b* narrow groove
48*c* upper end
50 branching base plate
50*a* round hole
54 branching body pipe
55 unit base
56 front surface cover (casing member)
56*a* identification window (aperture portion)
58 upper looper thread
59 lower looper thread
60 switching cam ring
60*a* left slope
60*b* right slope

The invention claimed is:

1. An overlock sewing machine comprising:

at least one looper including a receiving opening for receiving a looper thread and having a hollow structure through which the looper thread passes;

a thread inserting opening into which the looper thread is inserted that is to be inserted to the looper; a looper conduction pipe that guides the looper thread inserted into the thread inserting opening towards the receiving opening;

a slide pipe provided between the looper conduction pipe and the receiving opening and which one end is fitted to the looper conduction pipe in a freely slidable manner while its other end is provided to be movable between a threading position at which it is connected to the receiving opening and a sewing executing position at which the other end is separated from the receiving opening;

a slide member which is a member that holds the slide pipe and that moves between the threading position and the sewing executing position together with the slide pipe, having a long hole portion that extends along the moving direction and a wide hole portion that is formed in connection with the long hole portion and which width is formed to be larger than the width of the long hole portion;

a slide member spring for urging the slide member and the slide pipe towards the receiving opening side;

a main shaft that is rotationally driven;

a main shaft fixing plate that is fixed to the main shaft and that includes a notch at an outer peripheral position corresponding to a threading phase at which the receiving opening is at a position at which it is connectable to the other end of the slide pipe;

a first shaft which is an axial member which one end is provided to be movable between an engaging position at which it engages with the notch for fixing the main shaft at the threading phase and a retracted position at which it is completely separated from the main shaft fixing plate, comprising a small diameter portion and a large diameter portion at the other end thereof that respectively engage with the long hole portion and the wide hole portion of the slide member, wherein the position of the sliding member is maintained at each of the threading position and the sewing executing position through the engagement of the small diameter portion and the large diameter portion with the long hole portion and the wide hole portion;

a second shaft that is provided to be relatively movable along an axial direction of the first shaft;

a shaft spring for urging the first shaft and the second shaft in mutually separating directions;

a shaft pin that is provided at the second shaft to project from the second shaft or that engages with the second shaft to be integrally movable in an axial direction of the second shaft;

an engaging portion that is provided at the first shaft to engage with the shaft pin and/or the second shaft to receive force to move the first shaft towards the main shaft fixing plate side;

a rocking lever portion including a main shaft fixing operating arm portion provided with a shaft pin engaging portion that engages with the shaft pin or with the shaft pin and a main shaft fixing lever portion provided to be operable by a user and being rockable within a specified range; and a main shaft fixing operating spring which urging direction is switched to both rocking directions of the rocking lever portion by exceeding a neutral point through rocking operations of the rocking lever portion, wherein the rocking lever portion comprises a follower that obtains driving force upon abutment of the slide member to rotate the rocking lever portion, and wherein the slide member comprises an abutting portion that abuts the follower to rotate the rocking lever portion.

2. The overlock sewing machine as claimed in claim 1, comprising:

a casing member formed with an opening portion that is visible to at least the user at the time of operation, wherein a part of the first shaft and/or a part of an identifying member that moves integrally with the first shaft comes to a position at which it is exposed from the opening portion when the first shaft has moved to the retracted position to indicate that the sewing machine is in a sewing executable state in which the slide pipe and the slide member have moved to the sewing executing position so as to enable sewing.

3. The overlock sewing machine as claimed in claim 1, comprising:

a switch that allows driving of a motor for driving the main shaft only when the first shaft has moved to the retracted position so that the sewing machine is in a sewing executable state so as to enable sewing.

* * * * *